US008366908B2

(12) United States Patent
Prentice et al.

(10) Patent No.: US 8,366,908 B2
(45) Date of Patent: Feb. 5, 2013

(54) SOUR SERVICE HYDROPROCESSING FOR LUBRICANT BASE OIL PRODUCTION

(75) Inventors: Krista Marie Prentice, Bethlehem, PA (US); Gary Paul Schleicher, Milford, NJ (US); Lei Zhang, Vienna, VA (US); Timothy Lee Hilbert, Fairfax, VA (US); Michel A. Daage, Hellertown, PA (US); Sylvain Hantzer, Purcellville, VA (US); Wenyih F. Lai, Bridgewater, NJ (US); David Mentzer, Marshall, VA (US); William Francis Heaney, Bonita Springs, FL (US); Christine Nicole Elia, Bridgewater, NJ (US); Shifang Luo, Kingwood, TX (US); Stephen J. McCarthy, Center Valley, PA (US); Mohan Kalyanaraman, Media, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 554 days.

(21) Appl. No.: 12/655,120

(22) Filed: Dec. 23, 2009

(65) Prior Publication Data

US 2010/0187156 A1 Jul. 29, 2010

Related U.S. Application Data

(60) Provisional application No. 61/204,055, filed on Dec. 31, 2008.

(51) Int. Cl.
*C10G 73/02* (2006.01)
*C10G 73/38* (2006.01)
*C10G 45/58* (2006.01)
*C10G 45/64* (2006.01)

(52) U.S. Cl. ..... 208/28; 208/27; 208/57; 208/264

(58) Field of Classification Search ..... None
See application file for complete search history.

(56) References Cited

U.S. PATENT DOCUMENTS

| | | | | |
|---|---|---|---|---|
| 3,900,425 | A * | 8/1975 | Robinson | 502/159 |
| 4,247,388 | A * | 1/1981 | Banta et al. | 208/111.15 |
| 4,397,827 | A * | 8/1983 | Chu | 423/705 |
| 5,976,354 | A * | 11/1999 | Powers et al. | 208/89 |
| 2003/0102254 | A1 * | 6/2003 | Eijsbouts et al. | 208/216 R |
| 2004/0079677 | A1 * | 4/2004 | Farshid | 208/89 |
| 2005/0092654 | A1 * | 5/2005 | Ellis et al. | 208/89 |
| 2006/0252632 | A1 * | 11/2006 | Cody et al. | 502/64 |

FOREIGN PATENT DOCUMENTS

EP 0225053 A1 * 10/1987

OTHER PUBLICATIONS

Johnson, M.F.L., "Estimation of the Zeolite Content of a Catalyst from Nitrogen Adsorption Isotherms", J. Catalysis, 425 (1978).
Kramer, G. M., McVicker, G. B. and Ziemiak, J. J., J. Catalysis, 92, 355 (1985).

* cited by examiner

*Primary Examiner* — Walter D Griffin
*Assistant Examiner* — Derek Mueller
(74) *Attorney, Agent, or Firm* — Robert A. Migliorini

(57) ABSTRACT

An integrated process for producing lubricant base oils from feedstocks under sour conditions is provided. The ability to process feedstocks under higher sulfur conditions allows for reduced cost processing and increases the flexibility in selecting a suitable feedstock. The sour feed can be delivered to a catalytic dewaxing step without any separation of sulfur and nitrogen contaminants, or a high pressure separation can be used to partially eliminate contaminants.

44 Claims, 14 Drawing Sheets

Integrated Raffinate Hydroconversion-Dewaxing at 1800 psig
Lube Yield versus Pour Point Integrated Raffinate Hydroconversion-Dewaxing
Dewaxing Reactor Temperature versus Days On Stream Integrated Raffinate Hydroconversion-Dewaxing at 1000 psig
Lube Yield versus Pour Point

SOUR SERVICE HYDROPROCESSING FOR LUBRICANT BASE OIL PRODUCTION

CROSS-REFERENCE TO RELATED APPLICATIONS

This is a Non-Provisional Application that claims priority to U.S. Provisional Application No. 61/204,055 filed Dec. 31, 2008, which is herein incorporated by reference in its entirety.

FIELD

This invention provides a catalyst and a method of using such a catalyst for processing of high sulfur and/or nitrogen content feedstocks to produce lubricating oil basestocks.

BACKGROUND

Numerous processes are available for production of lubricating oil basestocks from oil fractions. Such processes often involve hydroprocessing some type of oil fraction, such as hydrotreating or hydroconversion of the raffinate from a solvent extraction, followed by dewaxing of the hydroprocessed fraction. A hydrofinishing step of some type is also typical to improve the properties of the resulting lube basestock.

One method of classifying lubricating oil basestocks is that used by the American Petroleum Institute (API). API Group II basestocks have a saturates content of 90 wt % or greater, a sulfur content of not more than 0.03 wt % and a VI greater than 80 but less than 120. API Group III basestocks are the same as Group II basestocks except that the VI is at least 120. A process scheme such as the one detailed above is typically suitable for production of Group II and Group III basestocks from an appropriate feed.

Unfortunately, conventional methods for producing a lube basestock are hindered due to differing sensitivities for the catalysts involved in the various stages. This limits the selection of feeds which are potentially suitable for use in forming Group II or higher basestocks. In conventional processing, the catalysts used for the initial hydroprocessing of the oil fraction often have a relatively high tolerance for contaminants such as sulfur or nitrogen. By contrast, catalysts for catalytic dewaxing usually suffer from a low tolerance for contaminants. In particular, dewaxing catalysts that are intended to operate primarily by isomerization are typically quite sensitive to the amount of sulfur and/or nitrogen present in a feed. If contaminants are present, the activity and selectivity of the dewaxing catalyst will be reduced.

To accommodate the differing tolerances of the catalysts involved in lube basestock production, the following features are typically incorporated into the basestock production process. First, the hydroprocessing step (such as raffinate hydroconversion) is run under sufficiently severe conditions to convert most of the organic sulfur and nitrogen in the feed into volatile compounds, such as $H_2S$ and $NH_3$. Second, a separation step is used between the hydroprocessing step and the dewaxing step which removes substantially all of these contaminants prior to the dewaxing step. The separation step requires extra equipment to be used during the lube production, which increases the overall cost of the process. Additionally, the hydroprocessing step may have to be run for converting the contaminants to a gaseous form under more severe conditions than otherwise needed to meet the lube basestock specifications such as viscosity, viscosity index, and sulfur content. Hence, there is a need for improved catalytic dewaxing processes and catalysts for use in such processes that eliminates the need for a separation step between the hydroprocessing process and the dewaxing process, and thus minimizes yield loss due to overconverting the lube feedstock in the hydroprocessing step for producing Group II and III lubricant basestocks from raffinates, hydrocracker bottoms or waxy feeds. Dewaxed lube oil yield is also maximized in the dewaxing zone.

SUMMARY

A process is provided for producing a lubricant basestock. A method for producing a lubricant basestock includes contacting a hydrotreated feedstock and a hydrogen containing gas with a dewaxing catalyst under effective catalytic dewaxing conditions. The combined total sulfur in liquid and gaseous forms is greater than 1000 ppm by weight on the hydrotreated feedstock basis. The dewaxing catalyst includes at least one non-dealuminated, unidimensional 10-member ring pore zeolite, at least one Group VIII metal and at least one low surface area, metal oxide refractory binder.

In one form of the present disclosure, a method for producing a lubricant basestock includes: contacting a hydrotreated feedstock and a hydrogen containing gas with a dewaxing catalyst under effective catalytic dewaxing conditions, wherein the combined total sulfur in liquid and gaseous forms fed to the contacting step is greater than 1000 ppm by weight on the hydrotreated feedstock basis, and wherein the dewaxing catalyst includes at least one non-dealuminated, unidimensional 10-member ring pore zeolite, at least one Group VIII metal and at least one low surface area metal oxide refractory binder.

In another form of the present disclosure, a method for producing a lubricant basestock includes: contacting a hydrotreated feedstock and a hydrogen containing gas with a dewaxing catalyst under effective catalytic dewaxing conditions, wherein prior to the contacting step, the effluent from the hydrotreating step is fed to at least one high pressure separator to separate the gaseous portion of the hydrotreated effluent from the liquid portion of the hydrotreated effluent, wherein the combined total sulfur in liquid and gaseous forms fed to the contacting step is greater than 1000 ppm by weight on the hydrotreated feedstock basis, and wherein the dewaxing catalyst includes at least one non-dealuminated, unidimensional 10-member ring pore zeolite, at least one Group VIII metal and at least one low surface area, metal oxide refractory binder.

DETAILED DESCRIPTION

Figure 1:
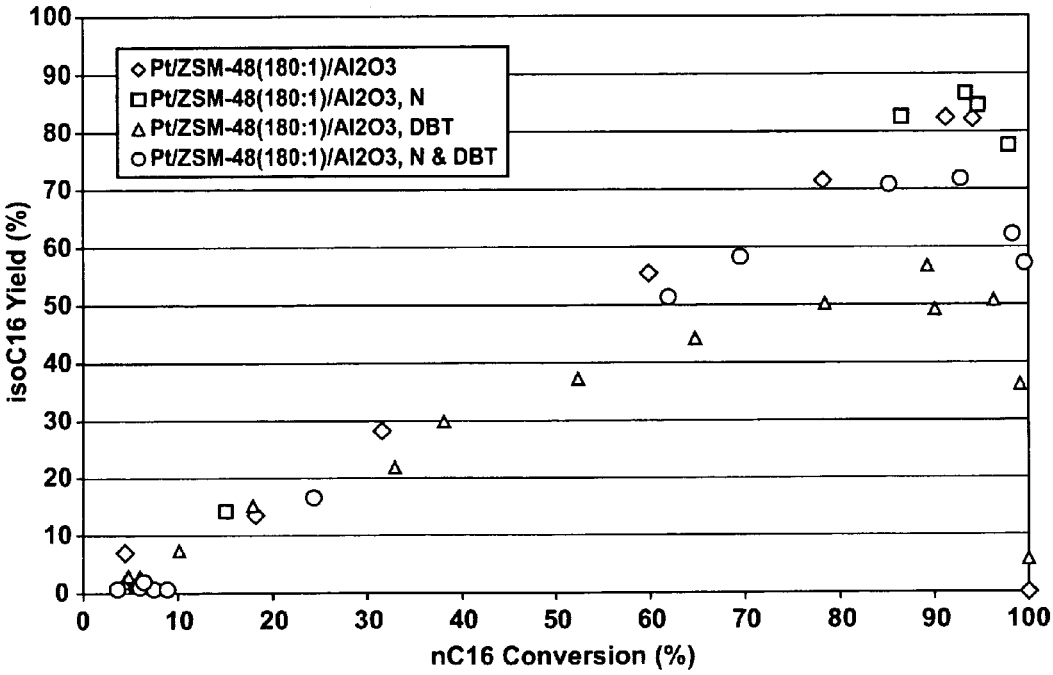
FIGS. 1 and 2 show the selectivity of comparative catalysts.

All numerical values within the detailed description and the claims herein are modified by "about" or "approximately" the indicated value, and take into account experimental error and variations that would be expected by a person having ordinary skill in the art.

Process Overview

In various embodiments, a process is provided for production of Group II and higher basestocks that includes catalytic dewaxing of the feed in a sour environment. A sour environment is one in which the total combined sulfur levels in liquid and gaseous forms is greater than 1000 ppm by weight on the hydrotreated feedstock basis. The ability to perform the catalytic dewaxing in a sour environment offers several advantages. The number and types of initial oil fractions available for lube basestock production can be expanded due to the tolerance for contaminants in the dewaxing step. The overall cost of the process should be lower, as the ability to perform dewaxing in a sour environment will reduce the equipment needed for processing. Finally, the yield for the lube production process may be improved, as the processing conditions will be selected to meet desired specifications, as opposed to selecting conditions to avoid the exposure of the dewaxing catalyst to contaminants.

The inventive process involves the use of a dewaxing catalyst suitable for use in a sour environment. The dewaxing catalysts used according to the invention provide an activity and/or selectivity advantage relative to conventional dewaxing catalysts in the presence of sulfur or nitrogen feeds. In the context of dewaxing, a high sulfur feed may include a feed containing, by weight, greater than 1000 ppm of sulfur, or at least 1,500 ppm of sulfur, or at least 2,000 ppm of sulfur, or at least 10,000 ppm of sulfur, or at least 40,000 ppm of sulfur. For the present disclosure, these sulfur levels are defined in terms of the total combined sulfur in liquid and gas forms fed to the dewaxing stage in parts per million (ppm) by weight on the hydrotreated feedstock basis.

This advantage is achieved by the use of a catalyst comprising a 10-member ring pore, one-dimensional zeolite in combination with a low surface area metal oxide refractory binder, both of which are selected to obtain a high ratio of micropore surface area to total surface area. Alternatively, the zeolite has a low silica to alumina ratio. The dewaxing catalyst further includes a metal hydrogenation function, such as a Group VIII metal, preferably a Group VIII noble metal. Preferably, the dewaxing catalyst is a one-dimensional 10-member ring pore catalyst, such as ZSM-48 or ZSM-23.

The external surface area and the micropore surface area refer to one way of characterizing the total surface area of a catalyst. These surface areas are calculated based on analysis of nitrogen porosimetry data using the BET method for surface area measurement. (See, for example, Johnson, M. F. L., Jour. Catal., 52, 425 (1978).) The micropore surface area refers to surface area due to the unidimensional pores of the zeolite in the dewaxing catalyst. Only the zeolite in a catalyst will contribute to this portion of the surface area. The external surface area can be due to either zeolite or binder within a catalyst.

Figure 13:
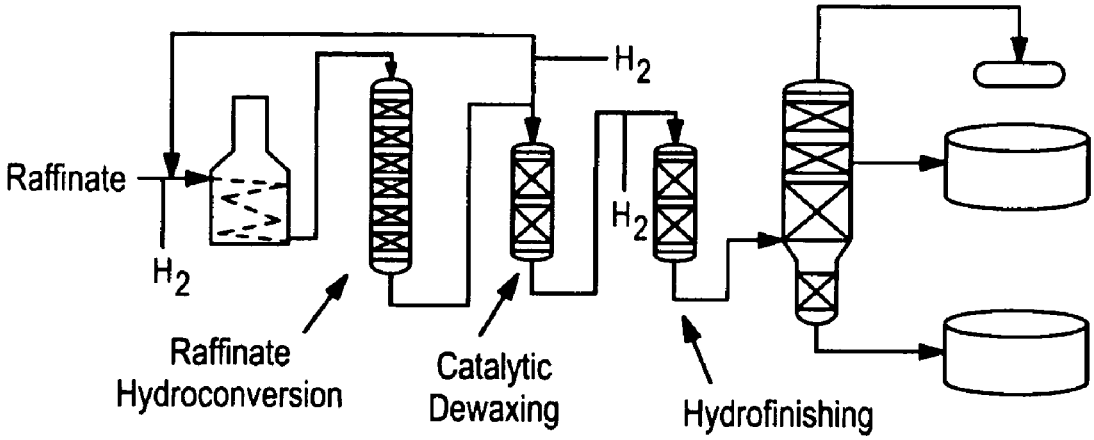
FIG. 13 is a depiction of the high severity direct cascade process scheme of FIG. 6 with hydroconversion followed by dewaxing and then hydrofinishing of raffinate feedstreams to produce Group II and higher basestocks.

The sour service catalytic dewaxing process may be preceded by a hydroconversion process where the entire effluent of the hydroconversion reactor is fed to the dewaxing process (see FIG. 13). There is no separation process between the hydroconversion process and the catalytic dewaxing process which allows for simplification of hardware and process parameters. In still yet another form, the hydroconversion and dewaxing processes may be integrated into a single reactor (with hydroconversion occurring prior to dewaxing) to further simplify process hardware. In yet another option, the effluent of the hydroconversion step may be fed to a high pressure separator in which the gaseous portion of the effluent is disengaged from the liquid portion of the effluent. The resulting effluent, which contains dissolved $H_2S$ and possibly organic sulfur, is then recombined with a hydrogen containing gas. The hydrogen containing gas may contain $H_2S$. The combined mixture is then fed to a sour service dewaxing step (see FIG. 7). In all three of these forms, a hydrofinishing process step follows the hydroconversion and dewaxing steps Alternatively in each of these forms, a fractionator may be included prior to or after the hydrofinishing process. The feed to the process may be a raffinate, a hydrocracker bottoms or a wax. A raffinate feed is defined as the liquid recovered after a solvent extraction of a distillate fraction. A hydrocracker bottoms feed is defined as the liquid fraction boiling above 600° F., preferably 650° F., recovered by stripping, distillation or fractionation of the total liquid product of a hydrocracking process. These processes are particularly effectively for producing Group II or III lube basestocks. A wax feed may be slack waxes, Fischer-Tropsch waxes, and combinations thereof.

Feedstocks

One example of a process according to the claimed invention includes raffinate hydroconversion followed by catalytic dewaxing in a sour environment. In such embodiments, a crude oil is subjected to several processing steps in order to make a lubricating oil basestock. The steps can include distillation (atmospheric distillation and/or vacuum distillation), solvent extraction to form a raffinate, hydroconversion, catalytic dewaxing, hydrofinishing and fractionation.

In an example including both an atmospheric and a vacuum distillation step, the high boiling petroleum fractions from an atmospheric distillation are sent to a vacuum distillation unit, and the distillation fractions from this unit are solvent extracted. The residue from vacuum distillation which may be deasphalted is sent to other processing. Other feeds suitable for solvent extraction include waxy streams such as dewaxed oils and foots oils.

The solvent extraction process selectively removes multi-ring aromatic and polar components in an extract phase while leaving the more paraffinic components in a raffinate phase. Naphthenes are distributed between the extract and raffinate phases. Typical solvents for solvent extraction include phenol, furfural and N-methyl pyrrolidone. By controlling the solvent to oil ratio, extraction temperature and method of contacting feed to be extracted with solvent, one can control the degree of separation between the extract and raffinate phases.

The raffinate from the solvent extraction is preferably under-extracted, i.e., the extraction is carried out under conditions such that the raffinate yield is maximized while still removing most of the lowest quality molecules from the feed. Raffinate yield may be maximized by controlling extraction conditions, for example, by lowering the solvent to oil treat ratio and/or decreasing the extraction temperature. The raffinate from the solvent extraction unit is stripped of solvent and then sent to a first hydroconversion unit containing a hydroconversion catalyst. This raffinate feed has a dewaxed oil viscosity index of from about 70 to about 105, a final boiling point not to exceed about 650° C., preferably less than 600° C., as determined by ASTM 2887 and a viscosity of from 3 to 12 cSt at 100° C.

The raffinate will typically also contain contaminants, such as sulfur and nitrogen. The sulfur content of the raffinate can be from 100 ppm by weight to up to 4 wt % or more of sulfur. In various embodiments, the raffinate is combined with a hydrogen containing gas. The raffinate and hydrogen containing gas mixture can include greater than 1,000 ppm by weight of sulfur or more, or 5,000 ppm by weight of sulfur or more, or 15,000 ppm by weight of sulfur or more. In yet another embodiment, the sulfur may be present in the gas only, the liquid only or both. For the present disclosure, these sulfur levels are defined as the total combined sulfur in liquid and gas forms fed to the dewaxing stage in parts per million (ppm) by weight on the hydrotreated feedstock basis.

Other types of suitable feeds can include hydrocracker bottoms having a sulfur content in the ranges disclosed above for raffinates as well as slack wax. Fischer-Tropsch waxes may be processed in combination with other feedstocks or in the presence of a sour hydrogen containing gas which may contain $H_2S$.

Initial Hydrotreatment of Feed

The raffinate from the solvent extraction process (or hydrocracker bottoms feed or waxy feed) can then be exposed to a suitable hydroconversion catalyst under hydroconversion conditions. In another alternative form, the raffinate or hydrocracker bottoms feed stream may be exposed in the same processing stage or reactor to the hydroconversion process followed by the catalytic dewaxing process. Hydroconversion catalysts are those containing Group VIB metals (based on the Periodic Table published by Fisher Scientific), and non-noble Group VIII metals, i.e., iron, cobalt and nickel and mixtures thereof. These metals or mixtures of metals are typically present as oxides or sulfides on refractory metal oxide supports. Suitable metal oxide supports include low acidic oxides such as silica, alumina or titania, preferably alumina. Preferred aluminas are porous aluminas such as gamma or eta having average pore sizes from 50 to 200 Å, preferably 75 to 150 Å, a surface area from 100 to 300 $m^2/g$, preferably 150 to 250 $m^2/g$ and a pore volume of from 0.25 to 1.0 $cm^3/g$, preferably 0.35 to 0.8 $cm^3/g$. The supports are preferably not promoted with a halogen such as fluorine as this generally increases the acidity of the support.

Preferred metal catalysts include cobalt/molybdenum (1-10% Co as oxide, 10-40% Mo as oxide) nickel/molybdenum (1-10% Ni as oxide, 10-40% Co as oxide) or nickel/tungsten (1-10% Ni as oxide, 10-40% W as oxide) on alumina. Especially preferred are nickel/molybdenum catalysts such as KF-840, KF-848 or a stacked bed of KF-848 or KF-840 and Nebula-20.

Alternatively, the hydroconversion catalyst can be a bulk metal catalyst, or a combination of stacked beds of supported and bulk metal catalyst. By bulk metal, it is meant that the catalysts are unsupported wherein the bulk catalyst particles comprise 30-100 wt. % of at least one Group VIII non-noble metal and at least one Group VIB metal, based on the total weight of the bulk catalyst particles, calculated as metal oxides and wherein the bulk catalyst particles have a surface area of at least 10 $m^2/g$. It is furthermore preferred that the bulk metal hydrotreating catalysts used herein comprise about 50 to about 100 wt. %, and even more preferably about 70 to about 100 wt. %, of at least one Group VIII non-noble metal and at least one Group VIB metal, based on the total weight of the particles, calculated as metal oxides. The amount of Group VIB and Group VIII non-noble metals can easily be determined VIB TEM-EDX.

Bulk catalyst compositions comprising one Group VIII non-noble metal and two Group VIB metals are preferred. It has been found that in this case, the bulk catalyst particles are sintering-resistant. Thus the active surface area of the bulk catalyst particles is maintained during use. The molar ratio of Group VIB to Group VIII non-noble metals ranges generally from 10:1-1:10 and preferably from 3:1-1:3. In the case of a core-shell structured particle, these ratios of course apply to the metals contained in the shell. If more than one Group VIB metal is contained in the bulk catalyst particles, the ratio of the different Group VIB metals is generally not critical. The same holds when more than one Group VIII non-noble metal is applied. In the case where molybdenum and tungsten are present as Group VIB metals, the molybenum:tungsten ratio preferably lies in the range of 9:1-1:9. Preferably the Group VIII non-noble metal comprises nickel and/or cobalt. It is further preferred that the Group VIB metal comprises a combination of molybdenum and tungsten. Preferably, combinations of nickel/molybdenum/tungsten and cobalt/molybdenum/tungsten and nickel/cobalt/molybdenum/tungsten are used. These types of precipitates appear to be sinter-resistant. Thus, the active surface area of the precipitate is maintained during use. The metals are preferably present as oxidic compounds of the corresponding metals, or if the catalyst composition has been sulfided, sulfidic compounds of the corresponding metals.

It is also preferred that the bulk metal hydrotreating catalysts used herein have a surface area of at least 50 $m^2/g$ and more preferably of at least 100 $m^2/g$. It is also desired that the pore size distribution of the bulk metal hydrotreating catalysts be approximately the same as the one of conventional hydrotreating catalysts. More in particular, these bulk metal hydrotreating catalysts have preferably a pore volume of 0.05-5 ml/g, more preferably of 0.1-4 ml/g, still more preferably of 0.1-3 ml/g and most preferably 0.1-2 ml/g determined by nitrogen adsorption. Preferably, pores smaller than 1 nm are not present. Furthermore these bulk metal hydrotreating catalysts preferably have a median diameter of at least 50 nm, more preferably at least 100 nm, and preferably not more than 5000 μm and more preferably not more than 3000 μm. Even more preferably, the median particle diameter lies in the range of 0.1-50 μm and most preferably in the range of 0.5-50 μm.

Hydroconversion catalysts can also include hydrocracking catalysts. These catalysts typically contain sulfided base metals on acidic supports, such as amorphous silica alumina, zeolites such as USY, acidified alumina. Often these acidic supports are mixed or bound with other metal oxides such as alumina, titania or silica.

Hydroconversion conditions in the first hydroconversion unit include a temperature of from 330 to 420° C., preferably 340 to 395° C., a hydrogen partial pressure of 800 to 3000 psig (5.6 to 13.8 MPa), preferably 800 to 1800 psig (5.6 to 12.5 MPa), a space velocity of from 0.2 to 3.0 LHSV, preferably 0.3 to 2.0 LHSV and a hydrogen to feed ratio of from 500 to 10,000 Scf/B (89 to 890 $m^3/m^3$), preferably 1800 to 4000 Scf/B (320 to 712.4 $m^3/m^3$).

In embodiments involving raffinate hydroconversion, preferably any supported catalysts used for hydroconversion will have a metal oxide support that is non-acidic so as to control cracking. A useful scale of acidity for catalysts is based on the isomerization of 2-methyl-2-pentene as described by Kramer and McVicker, J. Catalysis, 92, 355(1985). In this scale of acidity, 2-methyl-2-pentene is subjected to the catalyst to be evaluated at a fixed temperature, typically 200 degrees Celsius. In the presence of catalyst sites, 2-methyl-2-pentene forms a carbenium ion. The isomerization pathway of the carbenium ion is indicative of the acidity of active sites in the catalyst. Thus weakly acidic sites form 4-methyl-2-pentene whereas strongly acidic sites result in a skeletal rearrangement to 3-methyl-2-pentene with very strongly acid sites forming 2,3-dimethyl-2-butene. The mole ratio of 3-methyl-2-pentene to 4-methyl-2-pentene can be correlated to a scale of acidity. This acidity scale ranges from 0.0 to 4.0. Very weakly acidic sites will have values near 0.0 whereas very strongly acidic sites will have values approaching 4.0. The catalysts useful in the present process have acidity values of less than about 0.5, preferably less than about 0.3. The acidity of metal oxide supports can be controlled by adding promoters and/or dopants, or by controlling the nature of the metal oxide support, e.g., by controlling the amount of silica incorporated into a silica-alumina support. Examples of promoters and/or dopants include halogen, especially fluorine, phosphorus, boron, yttria, rare-earth oxides and magnesia. Promoters such as halogens generally increase the acidity of metal oxide supports while mildly basic dopants such as yttria or magnesia tend to decrease the acidity of such supports.

The above hydroconversion process is suitable for making a Group II and/or Group III lubricant basestock from a raffinate feed or a hydrocracker bottoms feed or a waxy feed. By modifying the nature of the hydroprocessing step, other types of feeds can be used and/or products can be made using the inventive configuration. With regard to the initial hydroprocessing step, rather than hydroconverting a raffinate feed, hydrocracker bottoms feed, or waxy feed, a severe hydrotreatment step or a hydrocracking step can be used. A severe hydrotreatment step is defined as one in which boiling point conversion to fuels is greater than 5 wt %. Still another alternative is to use a dealkylation step, where the primary reaction is to remove alkyl chains from aromatic compounds in the feed. Such a dealkylation step results in less conversion of heteroatom compounds, so more organic sulfur and nitrogen would remain in the effluent after a dealkylation process as compared to a hydroconversion process. Due to the lower conversion amounts, a process involving a dealkylation step may be more suitable for producing a Group I type lubricant basestock.

Dewaxing Process

The product from the hydroconversion is then directly cascaded into a catalytic dewaxing reaction zone. Unlike a conventional process, no separation is required between the hydroconversion and catalytic dewaxing stages. Elimination of the separation step has a variety of consequences. With regard to the separation itself, no additional equipment is needed. In some embodiments, the hydroconversion stage and the catalytic dewaxing stage may be located in the same reactor. Alternatively, the hydroconversion and catalytic dewaxing processes may take place in separate reactors. Eliminating the separation step saves the facilities investment costs and also avoids any need to repressurize the feed. Instead, the effluent from the hydroconversion stage can be maintained at processing pressures as the effluent is delivered to the dewaxing stage.

Eliminating the separation step between hydroconversion and catalytic dewaxing also means that any sulfur in the feed to the hydroconversion step will still be in the effluent that is passed from the hydroconversion step to the catalytic dewaxing step.

A portion of the organic sulfur in the feed to the hydroconversion step will be converted to $H_2S$ during hydroconversion. Similarly, organic nitrogen in the feed will be converted to ammonia. However, without a separation step, the $H_2S$ and $NH_3$ formed during hydroconversion will travel with the effluent to the catalytic dewaxing stage. The lack of a separation step also means that any light gases ($C_1$-$C_4$) formed during hydroconversion will still be present in the effluent. The total combined sulfur from the hydroconversion process in both organic liquid form and gas phase (hydrogen sulfide) may be greater than 1,000 ppm by weight, or at least 2,000 ppm by weight, or at least 5,000 ppm by weight, or at least 10,000 ppm by weight, or at least 20,000 ppm by weight, or at least 40,000 ppm by weight. For the present disclosure, these sulfur levels are defined in terms of the total combined sulfur in liquid and gas forms fed to the dewaxing stage in parts per million (ppm) by weight on the hydrotreated feedstock basis.

Elimination of a separation step between hydroconversion and catalytic dewaxing is enabled in part by the ability of a dewaxing catalyst to maintain catalytic activity in the presence of elevated levels of sulfur. Conventional dewaxing catalysts often require pre-treatment of a feedstream to reduce the sulfur content to less than a few hundred ppm in order to maintain lube yield production of greater than 80 wt %. By contrast, raffinates or hydrocracker bottoms or waxy feedstreams in combination with a hydrogen containing gas containing greater than 1000 ppm by weight total combined sulfur in liquid and gas forms based on the feedstream can be effectively processed using the inventive catalysts to create a lube at yields greater than 80 wt %. In an embodiment, the total combined sulfur content in liquid and gas forms of the hydrogen containing gas and raffinates or hydrocracker bottoms or waxy feedstream can be at least 0.1 wt %, or at least 0.2 wt %, or at least 0.4 wt %, or at least 0.5 wt %, or at least 1 wt %, or at least 2 wt %, or at least 4 wt %. Sulfur content may be measured by standard ASTM methods D2622.

In an alternative embodiment, a simple flash high pressure separation step without stripping may be performed on the effluent from the hydroconversion reactor without depressurizing the feed. In such an embodiment, the high pressure separation step allows for removal of any gas phase sulfur and/or nitrogen contaminants in the gaseous effluent. However, because the separation is conducted at a pressure comparable to the process pressure for the hydroconversion or dewaxing step, the effluent will still contain substantial amounts of dissolved sulfur. For example, the amount of dissolved sulfur in the form of $H_2S$ can be at least 100 vppm, or at least 500 vppm, or at least 1000 vppm, or at least 2000 vppm.

Hydrogen treat gas circulation loops and make-up gas can be configured and controlled in any number of ways. In the direct cascade, treat gas enters the hydroconversion reactor and can be once through or circulated by compressor from high pressure flash drums at the back end of the dewaxing section of the unit. In the simple flash configuration, treat gas can be supplied in parallel to both the hydroconversion and the dewaxing reactor in both once through or circulation mode. In circulation mode, make-up gas can be put into the unit anywhere in the high pressure circuit preferably into the dewaxing reactor zone. In circulation mode, the treat gas may be scrubbed with amine, or any other suitable solution, to remove $H_2S$ and $NH_3$. In another form, the treat gas can be recycled without cleaning or scrubbing. Alternately, the liquid effluent may be combined with any hydrogen containing gas, including but not limited to $H_2S$ containing gas. Make-up hydrogen can be added into the process unit anywhere in the high pressure section of the processing unit, preferably just prior to the catalytic dewaxing step.

Preferably, the dewaxing catalysts according to the invention are zeolites that perform dewaxing primarily by isomerizing a hydrocarbon feedstock. More preferably, the catalysts are zeolites with a unidimensional pore structure. Suitable catalysts include 10-member ring pore zeolites, such as EU-1, ZSM-35 (or ferrierite), ZSM-11, ZSM-57, NU-87, SAPO-11, and ZSM-22. Preferred materials are EU-2, EU-11, ZBM-30, ZSM-48, or ZSM-23. ZSM-48 is most preferred. Note that a zeolite having the ZSM-23 structure with a silica to alumina ratio of from about 20:1 to about 40:1 can sometimes be referred to as SSZ-32. Other molecular sieves that are isostructural with the above materials include Theta-1, NU-10, EU-13, KZ-1, and NU-23.

In various embodiments, the catalysts according to the invention further include a metal hydrogenation component. The metal hydrogenation component is typically a Group VI and/or a Group VIII metal. Preferably, the metal hydrogenation component is a Group VIII noble metal. More preferably, the metal hydrogenation component is Pt, Pd, or a mixture thereof.

The metal hydrogenation component may be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the catalyst can be at least 0.1 wt % based on catalyst, or at least 0.15 wt %, or at least 0.2 wt %, or at least 0.25 wt %, or at least 0.3 wt %, or at least 0.5 wt % based on catalyst. The amount of metal in the catalyst can be 5 wt % or less based on catalyst, or 2.5 wt % or less, or 1 wt % or less, or 0.75 wt % or less. For embodiments where the metal is Pt, Pd, another Group VIII noble metal, or a combination thereof, the amount of metal is preferably from 0.1 to 2 wt %, more preferably 0.25 to 1.8 wt %, and even more preferably from 0.4 to 1.5 wt %.

Preferably, the dewaxing catalysts used in processes according to the invention are catalysts with a low ratio of silica to alumina. For example, for ZSM-48, the ratio of silica to alumina in the zeolite can be less than 200:1, or less than 110:1, or less than 100:1, or less than 90:1, or less than 80:1. In preferred embodiments, the ratio of silica to alumina can be from 30:1 to 200:1, 60:1 to 110:1, or 70:1 to 100:1.

The dewaxing catalysts useful in processes according to the invention can also include a binder. In some embodiments, the dewaxing catalysts used in process according to the invention are formulated using a low surface area binder, a low surface area binder represents a binder with a surface area of 100 $m^2/g$ or less, or 80 $m^2/g$ or less, or 70 $m^2/g$ or less.

Alternatively, the binder and the zeolite particle size are selected to provide a catalyst with a desired ratio of micropore surface area to total surface area. In dewaxing catalysts used according to the invention, the micropore surface area corresponds to surface area from the unidimensional pores of zeolites in the dewaxing catalyst. The total surface corresponds to the micropore surface area plus the external surface area. Any binder used in the catalyst will not contribute to the micropore surface area and will not significantly increase the total surface area of the catalyst. The external surface area represents the balance of the surface area of the total catalyst minus the micropore surface area. Both the binder and zeolite can contribute to the value of the external surface area. Preferably, the ratio of micropore surface area to total surface area for a dewaxing catalyst will be equal to or greater than 25%.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst may range from 0.1 to 2.7 wt %, or 0.2 to 2 wt %, or 0.3 to 1 wt %.

In yet another embodiment, a binder composed of two or more metal oxides can also be used. In such an embodiment, the weight percentage of the low surface area binder is preferably greater than the weight percentage of the higher surface area binder.

Alternatively, if both metal oxides used for forming a mixed metal oxide binder have a sufficiently low surface area, the proportions of each metal oxide in the binder are less important. When two or more metal oxides are used to form a binder, the two metal oxides can be incorporated into the catalyst by any convenient method. For example, one binder can be mixed with the zeolite during formation of the zeolite powder, such as during spray drying. The spray dried zeolite/binder powder can then be mixed with the second metal oxide binder prior to extrusion.

Process conditions in the catalytic dewaxing zone include a temperature of from 240 to 420° C., preferably 270 to 400° C., a hydrogen partial pressure of from 1.8 to 34.6 mPa (250 to 5000 psi), preferably 4.8 to 20.8 mPa, a liquid hourly space velocity of from 0.1 to 10 v/v/hr, preferably 0.5 to 3.0, and a hydrogen circulation rate of from 35 to 1781.5 $m^3/m^3$ (200 to 10000 scf/B), preferably 178 to 890.6 $m^3/m^3$ (1000 to 5000 scf/B).

Hydrofinishing

The hydroconverted and dewaxed raffinate or hydrocracker bottoms or waxy stream is then conducted to another reactor where it is subjected to a cold (mild) hydrofinishing step. The catalyst in this hydrofinishing step may be the same as those described above for the first hydroconversion reactor. In a preferred embodiment, the catalyst for the hydrofinishing step can be a sulfided base metal hydrotreating catalyst. One preferred catalyst for the hydrofinishing step is KF-848.

Conditions in the reactor used for hydrofinishing include temperatures of from 170 to 330° C., preferably 200 to 300° C., a hydrogen partial pressure of from 250 to 3000 psig (1.8 to 13.9 MPa), preferably 800 to 1800 psig (5.6 to 12.6 MPa), a space velocity of from 0.5 to 5 LHSV, preferably 1 to 3.5 LHSV and a hydrogen to feed ratio of from 50 to 5000 Scf/B (8.9 to 890.6 $m^3/m^3$), preferably 1800 to 4000 Scf/B (320.6 to 712.5 $m^3/m^3$).

PROCESS EMBODIMENTS

Process Embodiment 1

Figure 6:
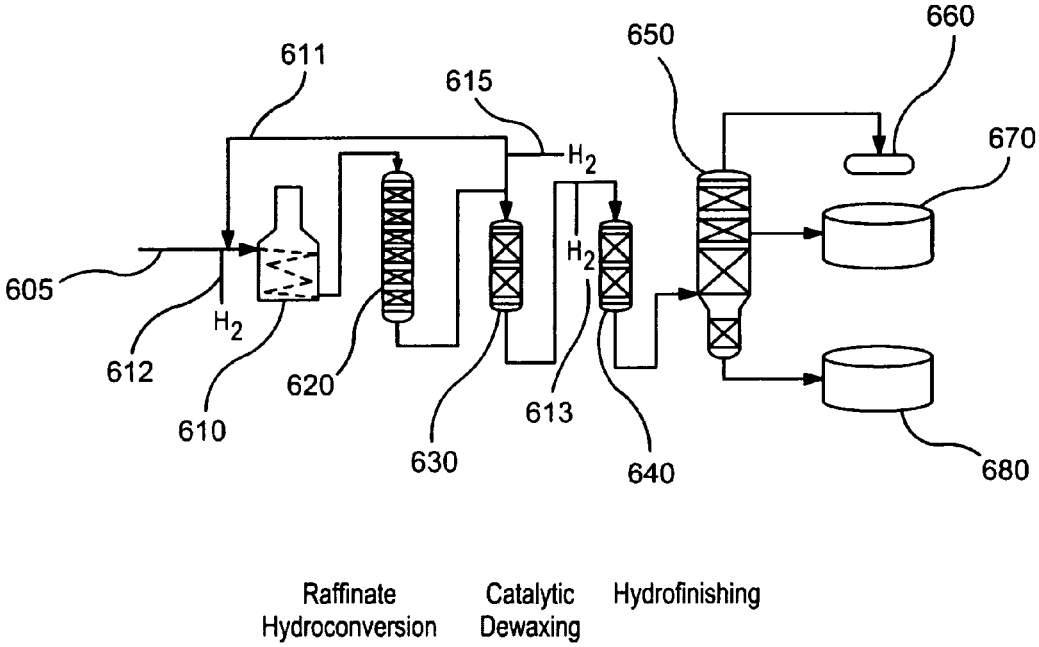
FIG. 6 schematically shows one embodiment of a process scheme for producing a lubricant basestock from a sour service feedstream to the dewaxing process (also referred to as high severity direct cascade process scheme).

FIG. 6 schematically shows one form of a reaction system suitable for carrying out dewaxing under sour conditions (also referred to as high severity direct cascade process scheme). In this process scheme, there are three reactors (hydroconversion, then dewaxing and then hydrofinishing) with the entire effluent from the hydroconversion reactor fed to the dewaxing reactor under sour conditions. Sour conditions are defined as the total combined sulfur in liquid organic form and/or gaseous form of greater than 1000 ppm by weight, or at least 2000 ppm by weight, or at least 5000 ppm by weight, or at least 10,000 ppm by weight, or at least 15,000 ppm by weight, or at least 20,000 ppm by weight, or at least 30,000 ppm by weight, or at least 40,000 ppm by weight. As previously described, for the present disclosure, these sulfur levels are defined in terms of the total combined sulfur in liquid and gas forms fed to the dewaxing stage in parts per million (ppm) by weight on the hydrotreated feedstock basis.

In FIG. 6, a feedstream 605 is provided with hydrogen 611 to a furnace, heat exchanger, or other heat source 610 to bring the feedstream up to a desired reaction temperature. The hydrogen supply 611 is partially composed of hydrogen from a hydrogen containing gas source 615. The hydrogen containing gas source 615 may contain $H_2S$. Optionally, a hydrogen supply source 612, may inject a hydrogen containing gas to a furnace, heat exchanger, or other heat source 610. The hydrogen containing supply source 612 may contain $H_2S$. In the embodiment shown in FIG. 6, feedstream 605 is a raffinate feedstream. Alternatively, the feedstream could be a hydrocracker bottoms stream or a waxy feed.

The heated feedstream then flows into a hydroconversion unit 620. The hydroconversion unit can be a raffinate hydroconversion unit, or alternatively a hydrotreatment or hydrocracking reactor can be used. The hydroconversion unit exposes the raffinates or hydrocracker bottoms or waxy feedstream to a suitable catalyst, such as a catalyst including both a Group VI and Group VIII metal, under effective hydroconversion conditions.

The entire effluent from the hydroconversion reactor is optionally mixed with additional hydrogen from a hydrogen source 615, and then flows into dewaxing reactor 630. Because no separation step is used between hydroconversion reactor 620 and dewaxing reactor 630, any sulfur or nitrogen contaminants in the effluent from the hydroconversion reactor 620 will also flow into dewaxing reactor 630. These sulfur or nitrogen contaminants may be in a different from the original feed, as the hydroconversion conditions will result in organic sulfur and nitrogen being converted into hydrogen sulfide and ammonia, for example. The effluent from the hydroconversion reactor is catalytically dewaxed in reactor 630 under effective dewaxing conditions. In an alternative embodiment, hydroconversion reactor 620 and dewaxing reactor 630 may be combined to form a single reactor with separate zones for hydroconversion and dewaxing.

The effluent from the dewaxing reactor then flows into a hydrofinishing reactor 640. Due to the difference in reaction conditions between a dewaxing and hydrofinishing process, hydrofinishing reactor 640 cannot be combined with dewaxing reactor 630. The effluent from the dewaxing reactor is exposed to a hydrofinishing catalyst under effective hydrofinishing conditions. Optionally, a hydrogen supply source 613, may inject a hydrogen containing gas to the hydrofinishing reactor 640.

The effluent from the hydrofinishing reactor is then separated into various cuts by fractionator 650. These cuts can include, for example, gas phase products from the previous processing steps (not shown), a lighter fuel type product such as a naphtha cut 660, a lighter fuel type product such as a diesel cut 670, and a desired lube basestock cut 680 such as a Group II, Group II+ or Group III cut.

Process Embodiment 2

Figure 7:
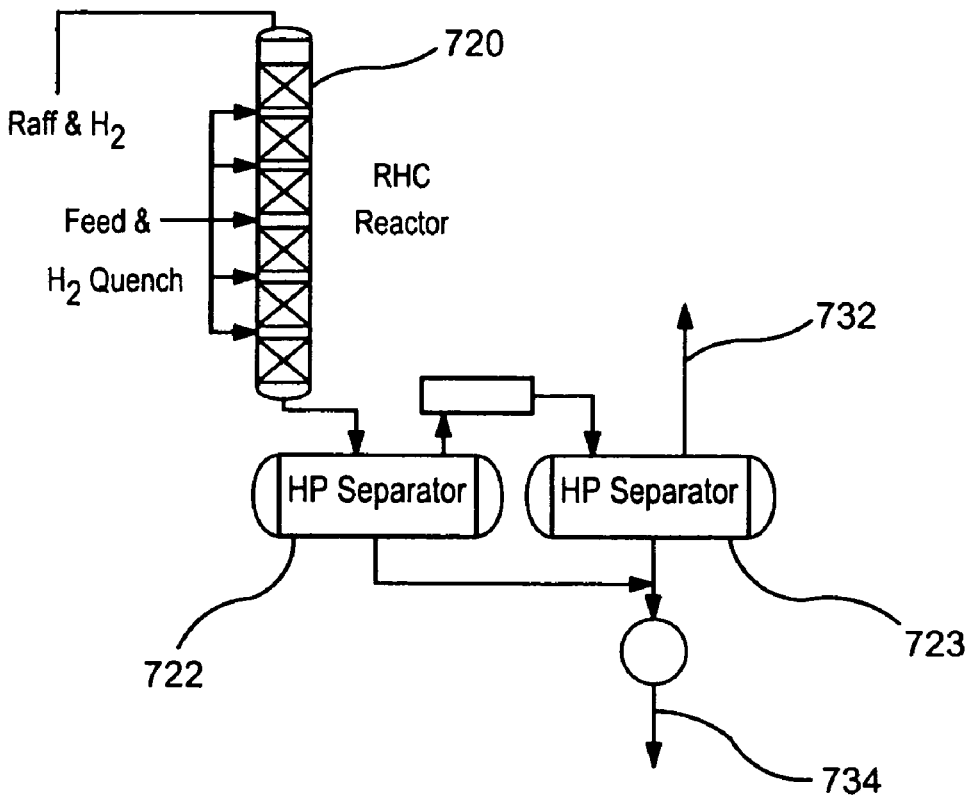
FIG. 7 schematically shows a second embodiment of a process scheme for producing a lubricant basestock from a sour service feedstream to the dewaxing process (also referred to as medium severity high pressure separation process scheme).

FIG. 7 shows an alternative embodiment for performing dewaxing under sour conditions (also referred to as medium severity high pressure separation process scheme). FIG. 7 schematically depicts a configuration for a hydroconversion reactor 720 and a subsequent high pressure separation device. In FIG. 7, the entire effluent from the hydroconversion reactor 720 is passed into at least one high pressure separation device, such as the pair of high pressure separators 722 and 723. The high pressure separation device disengages the gas phase portion of the effluent from the liquid phase portion. The resulting effluent 734, which contains dissolved $H_2S$ and possibly organic sulfur is then recombined with a hydrogen containing gas. The hydrogen containing gas may contain $H_2S$. The combined mixture is then fed to a sour service catalytic dewaxing step. The effluent from the dewaxing step is then fed to a hydrofinishing reactor and then separated into various cuts by a fractionator. These cuts can include, for example, gas phase products from the previous processing steps (not shown), a lighter fuel type product such as a naphtha cut, a lighter fuel type product such as a diesel cut, and a desired lube basestock cut such as a Group II, Group II+ or Group III cut. The high pressure separation will remove some gaseous sulfur and nitrogen from the effluent, which is removed as a sour gas stream 732 for further treatment. However, the separated effluent 734 that is passed to the dewaxing stage can still contain, for example, more than 1000 ppm by weight of total combined sulfur in liquid and gas forms on the hydrotreated feedstock basis. This partial reduction in the sulfur and nitrogen content of the effluent can improve the activity and/or lifetime of the dewaxing catalyst, as the dewaxing catalyst will be exposed to a less severe sour environment.

Process Embodiment 3

In yet another alternative embodiment for performing dewaxing under sour conditions, the hydroconversion process and the dewaxing process may be integrated into a single reactor because of the elimination of the separation process between the two and the proximity of process pressures. This mode is also referred to as single reactor high severity direct cascade mode. In this form, the raffinates or hydrocracker or waxy feedstream is fed to a single reactor where hydroconversion followed by dewaxing occurs. The entire effluent from the single reactor is then fed to a hydrofinishing reactor and then separated into various cuts by a fractionator. These cuts can include, for example, gas phase products from the previous processing steps (not shown), a lighter fuel type product such as a naphtha cut, a lighter fuel type product such as a diesel cut, and a desired lube basestock cut such as a Group II, Group II+ or Group III cut.

PROCESS EXAMPLES

In the process examples that follow, experiments 1-5, 10 and 12 are simulated experiments of a raffinate hydroconversion process (also designated RHC) followed by catalytic dewaxing (also designated CDW). Experiments 1-5, 10 and 12 simulate the integrated process schemes of FIGS. 6 and 13 with a sour service feed stream; however the total liquid product from the simulated RHC followed by CDW process was not hydrofinished. Experiments 6 and 8 are comparative examples for clean service feeds where a clean service feed represents the case of having separators and strippers in between RHC and CDW reactor(s). The total liquid products from Experiments 6 and 8 were not hydrofinished. Experiment 11 is also a comparative example for the case of using a conventional non-inventive dewaxing catalyst with a sour service feed. Experiments 7 and 11 are simulated experiments for raffinate hydroconversion (RHC) followed by high pressure separation and then catalytic dewaxing as depicted in FIG. 7 (medium severity high pressure separation process scheme). The total liquid products from Experiments 7 and 11 were not hydrofinished.

Experiment 9 is a comparative example where the sour service raffinate was subjected to only the catalytic dewaxing process disclosed herein. It would be necessary to perform a hydrotreatment step, such as hydroconversion, preferably prior to dewaxing, followed by a hydrofinishing step, as shown in FIGS. 6 and 13, to lower the aromatics and thus increase the percentage of saturates to an acceptable level for Group II or Group III lube basestocks.

In Experiments 1-5, 10 and 12 a series of catalysts were tested using a spiked feed to simulate the integrated RHC followed by CDW process. A spiked feed in Table 1 below refers to a 130 N RHC product feed spiked with Sulfrzol 54 and octylamine to produce a feed with about 0.7 to 0.8 wt % sulfur, and about 40 to 65 ppm by weight of nitrogen. In Experiments 7 and 11, a spiked feed was used to simulate RHC followed by high pressure separation and then catalytic dewaxing as shown in FIG. 7. The spiked feed shown in the table below refers to a 130 N RHC product feed spiked with Sulfrzol 54 and octylamine to produce a feed with about 0.1 to 0.2 wt % sulfur, and about 10 to 15 ppm by weight of nitrogen. In Experiments 6 and 8, a clean service process was simulated in which separators and strippers are in between RHC and CDW reactors. The clean service feed was a 130N RHC product feed containing less than 10 ppm by weight of sulfur and less than 10 ppm by weight of nitrogen. In experiment 9, a non-hydrotreated 130N raffinate, as shown in Table 1 below, was directly dewaxed.

In two experiments, designated as 260N Integrated RHC-Dewaxing at 1800 psig and 130N Integrated RHC-Dewaxing at 1800 psig, three reactors, a raffinate hydroconversion (RHC) reactor, catalytic dewaxing (CDW) reactor and hydrofinishing reactor, were run in series according to FIGS. 6 and 13 at operating conditions of 1800 psig. in another experiment, designated as 130N Integrated RHC-Dewaxing at 1000 psig, two reactors, a raffinate hydroconversion (RHC) reactor and catalytic dewaxing (CDW) reactor, were run in series at operating conditions of 1000 psig. The 260N and 130N raffinate feeds are shown in Table 1 below.

TABLE 1

| 130N Feed Description | Spiked 130N RHC Product* (Simulated FIG. 6) | Spiked 130N RHC Product* (Simulated FIG. 7) | 130N RHC Product (Clean Service Comparative Example) | 260N Raffinate Feed (260N Integrated RHC-Dewaxing) | 130N Raffinate Feed (130N Integrated RHC-Dewaxing) | 130N Raffinate Feed (RHC only Comparative Example) |
|---|---|---|---|---|---|---|
| 700° F.+ in Feed (wt %) | 96 | 97 | 97 | 99 | 96 | 94 |
| Solvent Dewaxed Oil Feed Pour Point, ° C. | −18 | −12 | −18 | −21 | −19 | −19 |
| Solvent Dewaxed Oil Feed 100° C. Viscosity, cSt | 4.2 | 4.5 | 4.2 | 8.2 | 4.8 | 4.9 |
| Solvent Dewaxed Oil Feed VI | 119 | 118 | 119 | 86.4 | 94.4 | 89.4 |
| Organic Sulfur in Feed (ppm by weight) | 7,278.4 | 1,512 | <5 | 12,000 | 8,200 | 11,700 |
| Organic Nitrogen in Feed (ppm by weight) | 48.4 | 11 | <5 | 113 | 52 | 74 |
| Experiment Number | 1-5, 10, 12 | 7, 11 | 6, 8 | 260N Integrated RHC-Dewaxing at 1800 psig | 130N Integrated RHC-Dewaxing at 1800 psig and at 1000 psig | 9 |

The catalysts used for the various experiments are shown in Table 2 below.

TABLE 2

| Experiment | Catalyst | Catalyst Parameters |
|---|---|---|
| 1 | 0.9% Pt/33% ZSM-48(90:1 $SiO_2$:$Al_2O_3$)/ 67% P25 $TiO_2$ | 0.9 wt % Pt/0.37 wt % Framework $Al_2O_3$/67 wt % P25 $TiO_2$ |

TABLE 2-continued

| | | |
|---|---|---|
| 2 | 1.2% Pt/65% ZSM-48(90:1 $SiO_2$:$Al_2O_3$)/35% P25 $TiO_2$ and 1.2% Pt/33% ZSM-48(90:1 SiO2:Al2O3)/67% P25 TiO2 | 1.2 wt % Pt/0.72 wt % Framework $Al_2O_3$/35 wt % P25 $TiO_2$ |
| 3 | 0.9% Pt/33% ZSM-48(90:1 $SiO_2$:$Al_2O_3$)/67% Dt-51D $TiO_2$ | 0.9 wt % Pt/0.37 wt % Framework $Al_2O_3$/67 wt % Dt-51D $TiO_2$ |
| 4 | 0.9% Pt/33% ZSM-48(90:1 $SiO_2$:$Al_2O_3$)/67% Catapal-200 Alumina | 0.9 wt % Pt/0.37 wt % Framework $Al_2O_3$/67 wt % Catapal-200 Alumina |
| 5 | 0.6% Pt/33% ZSM-48(90:1 $SiO_2$:$Al_2O_3$)/67% P25 $TiO_2$ | 0.6 wt % Pt/0.37 wt % Framework $Al_2O_3$/67 wt % P25 $TiO_2$ |
| 6 | 0.6% Pt/steamed/65% ZSM-48(90:1 $SiO_2$:$Al_2O_3$)/35% Versal-300 Alumina | 0.6 wt % Pt/0.72 wt % Framework $Al_2O_3$/35 wt % Versal-300 Alumina |
| 7 | 0.6% Pt/65% ZSM-48(90:1 $SiO_2$:$Al_2O_3$)/35% P25 $TiO_2$ | 0.6 wt % Pt/0.72 wt % Framework $Al_2O_3$/35 wt % P25 $TiO_2$ |
| 8 | 0.6% Pt/steamed/65% ZSM-48(90:1 $SiO_2$:$Al_2O_3$)/35% Versal-300 Alumina | 0.6 wt % Pt/0.72 wt % Framework $Al_2O_3$/35 wt % Versal-300 Alumina |
| 9 | 0.6% Pt/65% ZSM-48(90:1 $SiO_2$:$Al_2O_3$)/35% P25 $TiO_2$ | 0.6 wt % Pt/0.72 wt % Framework $Al_2O_3$/35 wt % P25 $TiO_2$ |
| 10 | 0.6% Pt/65% ZSM-48(90:1 $SiO_2$:$Al_2O_3$)/35% P25 $TiO_2$ | 0.6 wt % Pt/0.72 wt % Framework $Al_2O_3$/35 wt % P25 $TiO_2$ |
| 11 | 0.6% Pt/steamed/65% ZSM-48(90:1 $SiO_2$:$Al_2O_3$)/35% Versal-300 Alumina | 0.6 wt % Pt/0.72 wt % Framework $Al_2O_3$/35 wt % Versal-300 Alumina |
| 12 | 0.9% Pt/65% ZSM-23(135:1 $SiO_2$:$Al_2O_3$)/35% P25 $TiO_2$ | 0.9 wt % Pt/0.48 wt % Framework $Al_2O_3$/35 wt % P25 $TiO_2$ |
| 260N Integrated RHC-Dewaxing at 1800 psig | 0.9% Pt/33% ZSM-48(90:1 $SiO_2$:$Al_2O_3$)/67% P25 $TiO_2$ | 0.9 wt % Pt/0.37 wt % Framework $Al_2O_3$/67 wt % P25 $TiO_2$ |
| 130N Integrated RHC-Dewaxing at 1800 psig | 0.9% Pt/33% ZSM-48(90:1 $SiO_2$:$Al_2O_3$)/67% P25 $TiO_2$ | 0.9 wt % Pt/0.37 wt % Framework $Al_2O_3$/67 wt % P25 $TiO_2$ |
| 130N Integrated RHC-Dewaxing at 1000 psig | 0.9% Pt/33% ZSM-48(90:1 $SiO_2$:$Al_2O_3$)/67% P25 $TiO_2$ | 0.9 wt % Pt/0.37 wt % Framework $Al_2O_3$/67 wt % P25 $TiO_2$ |

| Experiment | Catalyst | Micropore surface area, $m^2/g$ | BET Total surface area, $m^2/g$ | Micropore surface area/Total surface area, % | Density, g/cc |
|---|---|---|---|---|---|
| 1 | 0.9% Pt/33% ZSM-48(90:1 $SiO_2$:$Al_2O_3$)/67% P25 $TiO_2$ | 67 | 148 | 45% | 0.87 |
| 2 | 1.2% Pt/65% ZSM-48(90:1 $SiO_2$:$Al_2O_3$)/35% P25 $TiO_2$ and 1.2% Pt/33% ZSM-48(90:1 SiO2:Al2O3)/67% P25 TiO2 | 100 | 195 | 51% | 0.72 |
| 3 | 0.9% Pt/33% ZSM-48(90:1 $SiO_2$:$Al_2O_3$)/67% Dt-51D $TiO_2$ | 46 | 141.2 | 33% | 0.66 |
| 4 | 0.9% Pt/33% ZSM-48(90:1 $SiO_2$:$Al_2O_3$)/67% Catapal-200 Alumina | 60 | 137 | 44% | 0.68 |
| 5 | 0.6% Pt/33% ZSM-48(90:1 $SiO_2$:$Al_2O_3$)/67% P25 $TiO_2$ | 67 | 148 | 45% | 0.82 |
| 6 | 0.6% Pt/steamed/65% ZSM-48(90:1 $SiO_2$:$Al_2O_3$)/35% Versal-300 Alumina | 50 | 232 | 22% | 0.5 |
| 7 | 0.6% Pt/65% ZSM-48(90:1 $SiO_2$:$Al_2O_3$)/35% P25 $TiO_2$ | 100 | 195 | 51% | 0.57 |
| 8 | 0.6% Pt/steamed/65% ZSM-48(90:1 $SiO_2$:$Al_2O_3$)/35% Versal-300 Alumina | 50 | 232 | 22% | 0.5 |
| 9 | 0.6% Pt/65% ZSM-48(90:1 $SiO_2$:$Al_2O_3$)/35% P25 $TiO_2$ | 100 | 195 | 51% | 0.57 |
| 10 | 0.6% Pt/65% ZSM-48(90:1 $SiO_2$:$Al_2O_3$)/35% P25 $TiO_2$ | 100 | 195 | 51% | 0.57 |
| 11 | 0.6% Pt/steamed/65% ZSM-48(90:1 $SiO_2$:$Al_2O_3$)/35% Versal-300 Alumina | 50 | 232 | 22% | 0.5 |

TABLE 2-continued

| | | | | | |
|---|---|---|---|---|---|
| 12 | 0.9% Pt/65% ZSM-23(135:1 $SiO_2$:$Al_2O_3$)/35% P25 $TiO_2$ | 161 | 244 | 66% | 0.47 |
| 260N Integrated RHC-Dewaxing at 1800 psig | 0.9% Pt/33% ZSM-48(90:1 $SiO_2$:$Al_2O_3$)/67% P25 $TiO_2$ | 67 | 148 | 45% | 0.87 |
| 130N Integrated RHC-Dewaxing at 1800 psig | 0.9% Pt/33% ZSM-48(90:1 $SiO_2$:$Al_2O_3$)/67% P25 $TiO_2$ | 67 | 148 | 45% | 0.87 |
| 130N Integrated RHC-Dewaxing at 1000 psig | 0.9% Pt/33% ZSM-48(90:1 $SiO_2$:$Al_2O_3$)/67% P25 $TiO_2$ | 67 | 148 | 45% | 0.87 |

In one integrated process configuration (designated herein 260N Integrated RHC-Dewaxing process at 1800 psig), reactor 1 (also designated RHC or R1 unit), was operated to establish organic sulfur less than 300 ppm by weight prior to starting the subsequent dewaxing reactor (also designated CDW or R2 unit). The RHC was operated with 100 cc KF-848 catalyst, a feed of 260N raffinate as described in Table 1, pressure=1800 psig, 1 LHSV, 2500 SCF/B for hydrogen gas to feed ratio, and temperature @ 115.5 viscosity index=387.4° C. These RHC conditions were end of run conditions due to an operational problem (valve stuck in the open position during start of run). The CDW R2 unit was operated with 100 cc 0.9% Pt/ZSM-48 (90:1 $SiO_2$:$Al_2O_3$)/P25 $TiO_2$ catalyst, pressure=1800 psig, 1 LHSV, 2110.5 SCF/B for hydrogen gas to feed ratio, temperature=363.5° C. at total liquid product pour point of −20° C. The hydrofinishing reactor (also designate HF or R3 unit) was run with 28.5 cc KF-848 catalyst, pressure=1800 psig, 3.5 LHSV, <2110.5 SCF/B for hydrogen gas to feed ratio, and a temperature=250° C. The RHC, CDW, and hydrofinishing reactors were run in series in an integrated, direct cascade configuration.

In another integrated process configuration (designated herein 130N Integrated RHC-Dewaxing process at 1800 psig), reactor 1 (also designated RHC or R1 unit) was operated to establish organic sulfur less than 300 ppm by weight prior to starting the subsequent dewaxing reactor (also designated CDW or R2 unit). The RHC R1 unit was operated with stacked bed of 50 cc KF-848 catalyst and 50 cc Nebula-20 catalyst, a feed=130N raffinate as described in Table 1, 1800 psig, 1 LHSV, 2500 SCF/B for hydrogen gas to feed ratio and temperature @ 115.4 viscosity index=341° C. The CDW R2 unit was operated with 100 cc 0.9% Pt/ZSM-48 (90:1 $SiO_2$:$Al_2O_3$)/P25 $TiO_2$ catalyst, 1800 psig, 1 LHSV, ~2150SCF/B for hydrogen gas to feed ratio, temperature=353° C. at total liquid product pour point of −20° C. The hydrofinishing reactor (also designate HF or R3 unit) was run with 28.5 cc KF-848 catalyst, pressure=1800 psig, 3.5 LHSV, <2150 SCF/B for hydrogen gas to feed ratio, and a temperature=250° C. The RHC, CDW, and hydrofinishing reactors were run in series in an integrated, direct cascade configuration.

In another integrated process configuration (designated herein 130N Integrated RHC-Dewaxing process at 1000 psig), reactor 1 (also designated RHC or R1 unit) was operated to establish organic sulfur less than 300 ppm by weight prior to starting the subsequent dewaxing reactor (also designated CDW or R2 unit). The RHC R1 unit was operated with stacked bed of 50 cc KF-848 catalyst and 50 cc Nebula-20 catalyst, a feed=130N raffinate as described in Table 1, 1000 psig, 1 LHSV, 2500 SCF/B for hydrogen gas to feed ratio and temperature @ 114 viscosity index=350° C. The CDW R2 unit was operated with 100 cc 0.9% Pt/ZSM-48 (90:1 $SiO_2$:$Al_2O_3$)/P25 $TiO_2$ catalyst, 1000 psig, 1 LHSV, ~2099 SCF/B for hydrogen gas to feed ratio, temperature=349° C. at total liquid product pour point of −20° C. The RHC and CDW reactors were run in series in an integrated, direct cascade configuration.

Experiments 1-6 and 12 were conducted on a 100 cc single reactor, pilot plant unit in an upflow configuration and Experiments 7-11 on a 10 cc single reactor, pilot plant unit in an upflow configuration using a variety of clean and sour feeds. Clean feeds simulate the case of having full gas stripping facilities between RHC and the CDW reactors and provide for comparative data to the inventive integrated, direct cascade process of the present disclosure. The dewaxing process conditions are shown below for each experiment.

Experiment #1 was conducted under the following conditions: Simulated RHC-Dewaxing integrated process using a spiked 130N RHC product feed as shown in Table 1. Catalytic dewaxing conditions: catalyst—100 cc 0.9% Pt/33% ZSM-48 (90:1 $SiO_2$:$Al_2O_3$)/67% P25 $TiO_2$, 1800 psig, 1 LHSV, 2500 SCF/B for hydrogen gas to feed ratio, Temperature=349° C. at total liquid product pour point of −20° C. The catalyst was loaded into the reactor by volume.

Experiment #2 was conducted under the following conditions: Simulated RHC-Dewaxing integrated process using a spiked 130N RHC product feed as shown in Table 1. Catalytic dewaxing conditions: catalyst—about 50 cc of 1.2% Pt/65% ZSM-48 (90:1 $SiO_2$:$Al_2O_3$)/35% P25 $TiO_2$, and about 50 cc of 1.2% Pt/33% ZSM-48 (90:1 $SiO_2$:$Al_2O_3$)/67% P25 $TiO_2$, 1800 psig, 1 LHSV, 2500 SCF/B for hydrogen gas to feed ratio, temperature=343° C. at total liquid product pour point of −20° C. The catalyst was loaded into the reactor by volume.

Experiment #3 was conducted under the following conditions: Simulated RHC-Dewaxing integrated process using a spiked 130N RHC product feed as shown in Table 1. Catalytic dewaxing conditions: catalyst—100 cc 0.9% Pt/33% ZSM-48 (90:1 $SiO_2$:$Al_2O_3$)/67% Dt-51D $TiO_2$, 1800 psig, 1 LHSV, 2500 SCF/B for hydrogen gas to feed ratio, temperature=359° C. at total liquid product pour point of −20° C. The catalyst was loaded into the reactor by volume.

Experiment #4 was conducted under the following conditions: Simulated RHC-Dewaxing integrated process using a spiked 130N RHC product feed as shown in Table 1. Catalytic dewaxing conditions: catalyst—100 cc 0.9% Pt/33% ZSM-48 (90:1 $SiO_2$:$Al_2O_3$)/67% Catapal-200 Alumina, 1800 psig, 1 LHSV, 2500 SCF/B for hydrogen gas to feed ratio, temperature=365° C. at total liquid product pour point of −20° C. The catalyst was loaded into the reactor by volume.

Experiment #5 was conducted under the following conditions: Simulated RHC-Dewaxing integrated process using a spiked 130N RHC product feed as shown in Table 1. Catalytic dewaxing conditions: catalyst—100 cc 0.6% Pt/33% ZSM-48 (90:1 $SiO_2$:$Al_2O_3$)/67% P25 $TiO_2$, 1800 psig, 1 LHSV, 2500 SCF/B for hydrogen gas to feed ratio, temperature=352° C. at total liquid product pour point of −20° C. The catalyst was loaded into the reactor by volume.

Experiment #6 (comparative example) was conducted under the following conditions: Simulated RHC-hot separation and stripping-Dewaxing process using a Clean 130N RHC product feed as shown in Table 1. Catalytic dewaxing conditions: catalyst—100 cc 0.6% Pt/Steamed/65% ZSM-48 ($SiO_2$:$Al_2O_3$)/35% Versal-300 Alumina, 1800 psig, 1 LHSV, 2500 SCF/B for hydrogen gas to feed ratio, temperature=310° C. at total liquid product pour point of −20° C. This comparative experiment shows 700° F.+ lube yield for a clean service process for comparison to inventive sour service processes disclosed herein. The catalyst was loaded into the reactor by volume.

Experiment #7 was conducted under the following conditions: Simulated Medium Severity 130N RHC product feed and High Pressure Separation with integrated, direct cascade. Catalytic dewaxing conditions: catalyst—10 cc 0.6% Pt/65% ZSM-48 (90:1 $SiO_2$:$Al_2O_3$)/35% P25 $TiO_2$, 1800 psig, 1 LHSV, 2500 SCF/B, temperature=337° C. at total liquid product pour point of −20° C.

Experiment #8 (comparative example) was conducted under the following conditions: Simulated RHC-hot separation and stripping-Dewaxing process using a Clean 130N RHC product feed as shown in Table 1. Catalytic dewaxing conditions: catalyst—10 cc 0.6% Pt/Steamed/65% ZSM-48 ($SiO_2$:$Al_2O_3$)/35% Versal-300 Alumina, 1800 psig, 1 LHSV, 2500 SCF/B for hydrogen gas to feed ratio, temperature=315° C. at total liquid product pour point of −20° C. This comparative experiment shows 700° F.+ lube yield for a clean service process for comparison to inventive sour service processes disclosed herein. The catalyst was loaded into the reactor by volume.

Experiment #9 was conducted under the following conditions: Direct dewaxing of an unhydrotreated 130N Raffinate feed as shown in Table 1. Catalytic dewaxing conditions: catalyst—10 cc 0.6% Pt/65% ZSM-48 (90:1 $SiO_2$:$Al_2O_3$)/35% P25 $TiO_2$, 1800 psig, 1 LHSV, 2500 SCF/B for hydrogen gas to feed ratio, temperature=380° C. at total liquid product pour point of −20° C. The catalyst was loaded into the reactor by volume.

Experiment #10 was conducted under the following conditions: Simulated RHC-Dewaxing integrated process using a spiked 130N RHC product feed as shown in Table 1. Catalytic dewaxing conditions: catalyst—10 cc 0.6% Pt/65% ZSM-48 (90:1 $SiO_2$:$Al_2O_3$)/35% P25 $TiO_2$, 1800 psig, 1 LHSV, 2500 SCF/B for hydrogen gas to feed ratio, temperature=372° C. at total liquid product pour point of −20° C. The catalyst was loaded into the reactor by volume.

Experiment #11 (comparative example) was conducted under the following conditions: Simulated RHC-hot separation-Dewaxing process using a spiked 130N RHC product feed as shown in Table 1. Catalytic dewaxing conditions: catalyst—10 cc 0.6% Pt/Steamed/65% ZSM-48 ($SiO_2$:$Al_2O_3$)/35% Versal-300 Alumina, 1800 psig, 1 LHSV, 2500 SCF/B for hydrogen gas to feed ratio, temperature=335° C. at total liquid product pour point of −20° C. This comparative experiment shows that the conventional catalyst does not maintain yield in a sour environment. The catalyst was loaded into the reactor by volume.

Experiment #12 was conducted under the following conditions: Simulated RHC-Dewaxing integrated process using a spiked 130N RHC product feed as shown in Table 1. Catalytic dewaxing conditions: catalyst−100 cc 0.9% Pt/65% ZSM-23 (135:1 $SiO_2$:$Al_2O_3$)/35% P25 $TiO_2$, 1800 psig, 0.54 LHSV, 2500 SCF/B for hydrogen gas to feed ratio, temperature=373° C. at total liquid product pour point of −20° C. The catalyst was loaded into the reactor by volume.

In Table 3 below, the results from catalytic dewaxing experiments at specified conditions shown above are depicted. Experiment 1-6 and 12 were run in 100 cc reactors. Experiment 6 demonstrates the catalytic dewaxing performance for a catalyst shown in Table 2 including a conventional binder with a clean feed using a 100 cc reactor. Experiments 1 and 2 show catalytic dewaxing performance for different catalysts shown in Table 2 using a spiked sour 130N RHC product feed containing sulfur levels between 0.7 and 0.8 wt %. The metal to acid ratios of the catalysts in Experiments 1 and 2 were tuned to produce similar 700° F.+ lube yields as the comparative clean service example in Experiment 6. In addition, the ratio of micropore surface area to total surface area of all the catalysts used in Experiments 1 and 2 is greater than 25%.

Experiments 3 and 4 show catalytic dewaxing performance for different catalysts shown in Table 2 using a spiked sour 130N RHC product feed containing sulfur levels between 0.7 and 0.8 wt %. The density of the catalyst used in Experiment 3 (0.66 grams/cc) and in Experiment 4 (0.68 grams/cc) was lower than the density of the catalyst used in Experiment 1 (0.87 grams/cc). Experiments 1-11 were run at 1 LHSV. The resulting 700° F.+ lube yields for both Experiments 3 and 4 were lower than the 700° F.+ lube yield for Experiment 1 which may be due to the differences in the density of the catalysts. Experiments 3 and 4 may need to be run at a slightly lower LHSV or the metal to acid ratio may need to be tuned to account for the density differences in order to produce a similar 700° F.+ lube yield as in Experiment 1.

Experiment 5 shows catalytic dewaxing performance for a different catalyst shown in Table 2 using a spiked sour 130N RHC product feed containing sulfur levels between 0.7 and 0.8 wt %. The catalyst in Experiment 5 is not as optimized in terms of metal to acid ratio as the catalyst used in Experiment 1. The resulting lower 700° F.+ lube yield may be due to the metal to acid ratio of the catalyst used in Experiment 5 as compared to the catalyst used in Experiment 1.

Experiment 12 shows catalytic dewaxing performance for a different catalyst shown in Table 2 using a spiked sour 130N RHC product feed containing sulfur levels between 0.7 and 0.8 wt %. The catalyst in Experiment 12 uses a ZSM-23 crystal as opposed to a ZSM-48 crystal used in Experiment 1. Experiment 12 was run at 0.54 LHSV to account for the density difference between the catalyst used in Experiment 12 (0.47 grams/cc) and the catalyst used in Experiment 1 (0.87 grams/cc). The metal to acid ratio was tuned to be similar to the metal to acid ratio of the catalyst used in Experiment 1. The resulting lower 700° F.+ lube yield achieved in Experiment 12 as compared to Experiment 1 may be due to the differences between ZSM-23 and ZSM-48. ZSM-48 is more preferred than ZSM-23 based on the higher 700° F.+ lube yield achieved at a higher LHSV in Experiment 1 as compared to Experiment 12.

Experiments 7-11 were run in 10 cc reactors. Experiment 8 demonstrates the catalytic dewaxing performance for a catalyst shown in Table 2 including a conventional binder with a clean feed using a 10 cc reactor. Experiment 7 shows catalytic dewaxing performance using a spiked sour 130N RHC product feed containing sulfur levels between 0.1 and 0.2 wt %. The metal to acid ratio of the catalyst used in Experiment 7 was not optimized for high 700° F.+ lube yield of greater than 80 wt %. The same type of catalyst, shown in Table 2, used in Experiment 7 was used in Experiment 10 using a spiked sour 130N RHC product feed containing sulfur levels between 0.7 and 0.8 wt %. Again, the metal to acid ratio was not optimized for high 700° F.+ lube yield.

Experiment 11 is a comparative example using a conventional catalyst shown in Table 2. As for Experiment 7, Experiment 11 shows catalytic dewaxing performance using a spiked sour 130N RHC product feed containing sulfur levels between 0.1 and 0.2 wt %. This comparative experiment shows that the conventional catalyst does not maintain yield in a sour environment. The differences between the catalysts in Experiment 7 and Experiment 11 are the binder and the density. The binder used for the catalyst in Experiment 7 is P25 $TiO_2$ and the binder used for the catalyst in Experiment 11 is Versal-300 Alumina. The density of the catalyst used in Experiment 7 is 0.57 g/cc and the density of the catalyst used in Experiment 11 is 0.5 g/cc. The use of a low surface area, metal oxide refractory binder for the catalyst in Experiment 7 may have provided better performance in sour environments than the conventional binder, which has a higher surface area, used for the catalyst in Experiment 11. In addition, the ratio of micropore surface area to total surface area for the catalyst used in Experiment 11 is less than 25% as compared to 51% for Experiment 7. Catalysts with a ratio of micropore surface area to total surface area of greater than or equal to 25% may provide better performance in sour environments than catalysts with a ratio of micropore surface area to total surface area of less than 25%.

Experiment 9 shows catalytic dewaxing performance using 130N Raffinate feed containing sulfur levels between 1.1 and 1.2 wt %. The 130N Raffinate feed used in Experiment 9 was not hydrotreated. The same type of catalyst, as shown in Table 2, used in Experiment 9 was used in Experiment 10. The main difference between Experiments 9 and 10 is that in Experiment 10, a hydrotreated 130N feed was dewaxed and in Experiment 9, an unhydrotreated 130N feed was dewaxed. The percentage of saturates for Experiment 9 is about 72.5%. The percentage of saturates for Experiment 10 is about 98%. By not hydrotreating the feed prior to dewaxing, the resulting 700° F.+ product did not meet API approved specifications for percent saturates of greater than or equal to 90% for a Group II or Group III lube.

TABLE 3

| Preliminary Lube Basestock Specifications | Experiment 1 | Experiment 2 | Experiment 3 | Experiment 4 | Experiment 5 | Experiment 6 |
|---|---|---|---|---|---|---|
| 700° F.+ Lube Yield (wt %) at Total Liquid Product Pour Point of −20° C. | 87 | 88 | 83.4 | 82.4 | 85 | 89.4 |
| 700° F.+ Lube Pour Point, ° C. | −20 | −20 | −18 | −24 | −14 | −15 |
| 700° F.+ Lube 100° C. Viscosity, cSt | 4.3 | 4.3 | 4 | 4.1 | 4 | 4 |
| 700° F.+ Lube VI | 124 | 123 | 123 | 121 | 125 | 123 |
| 700° F.+ Lube % Saturates (wt %) | 99* | 99* | 99* | 98* | 98.5** | 99.9** |

| Preliminary Lube Basestock Specifications | Experiment 7 | Experiment 8 | Experiment 9 | Experiment 10 | Experiment 11 | Experiment 12 |
|---|---|---|---|---|---|---|
| 700° F.+ Lube Yield (wt %) at Total Liquid Product Pour Point of −20° C. | 81 | 85 | 71 | 74 | 74.4 | 82.5 |
| 700° F.+ Lube Pour Point, ° C. | −20 | −18 | −14 | −20 | −18 | −17 |
| 700° F.+ Lube 100° C. Viscosity, cSt | 4.2 | 4.2 | 5 | 4.2 | 4.5 | 4 |
| 700° F.+ Lube VI | 121 | 122 | 96 | 119 | 114 | 121.5 |
| 700° F.+ Lube % Saturates (wt %)* | 99.6** | 99.9** | 72.5** | 98** | 99.4** | 98* |

*% Saturates (wt %) = [1 − (Total Aromatics of 700° F.+ Lube (moles/gram) * Calculated Molecular Weight)] * 100 where Molecular Weight is calculated based on Kinematic Viscosity at 100° C. and 40° C. of the 700° F.+ Lube.
**% Saturates (wt %) = [1 − (Total Aromatics of Total Liquid Product (moles/gram) * Calculated Molecular Weight)] * 100 where Molecular Weight is calculated based on Kinematic Viscosity at 100° C. and 40° C. of the 700° F.+ Lube.

The preliminary lube basestock specifications are shown in Table 4 below for the 3-reactor integrated run using real raffinate feeds, and not simulated feeds. For the 3-reactor integrated run, raffinate hydroconversion (RHC) was performed in reactor 1. The entire effluent was sent to reactor 2 without any gas stripping or separation taking place between reactors 1 and 2. Catalytic dewaxing (CDW) in a sour environment took place in reactor 2. The entire effluent was then sent to reactor 3 without any gas stripping or separation taking place between reactors 2 and 3. Hydrofinishing (HF) took place in reactor 3 in a sour environment. Two experiments were run using the 3-reactor integrated configuration. The first experiment used a 260N Raffinate feed and the second experiment used a 130N Raffinate feed. For both experiments, the reactor pressure for the RHC, CDW and HF reactors was 1800 psig. The RHC conditions using the 260N Raffinate feed were end of run conditions due to an operational problem (valve stuck in the open position during start of run) resulting in a slightly lower percentage of saturates in the resulting lube basestock.

The preliminary lube basestock specifications are shown in Table 5 below for the 2-reactor integrated run using a real raffinate feed, and not simulated feeds. For the 2-reactor integrated run, raffinate hydroconversion (RHC) was performed in reactor 1. The entire effluent was sent to reactor 2 without any gas stripping or separation taking place between reactors 1 and 2. Catalytic dewaxing (CDW) in a sour environment took place in reactor 2. A 130N raffinate feed was used for the 2-reactor integrated run. The reactor pressure was 1000 psig for both the RHC and CDW reactors. Running at 1000 psig as opposed to 1800 psig resulted in a higher overall integrated 700° F.+ lube yield for 130N integrated RHC-Dewaxing. In both the 1000 psig and 1800 psig 130N integrated RHC-Dewaxing experiments, the 700° F.+ lube % saturates were greater than 95%.

TABLE 4

| Preliminary Lube Basestock Specifications | 260N* | 130N** |
|---|---|---|
| Integrated 700° F.+ Lube Yield (wt %) (R1-R2-R3) at Total Liquid Product Pour Point of −20° C. | 67 | 67 |
| Dewaxing 700° F.+ Lube Yield (wt %) (R2) at Total Liquid Product Pour Point of −20° C. | 84.4 | 87 |
| 700° F.+ Lube Pour Point, ° C. | −19 | −20 |
| 700° F.+ Lube 100° C. Viscosity, cSt | 5.7 | 4 |
| 700° F.+ Lube VI | 115.5 | 115.4 |
| 700° F.+ Lube % Saturates (wt %)*** | 93.6* | 99.2 |

*EOR KF-848 RHC conditions with 260N

**KF-848/Nebula-20 for RHC with 130N

***% Saturates (wt %) = [1 − (Total Aromatics of 700° F.+ Lube (moles/gram) * Calculated Molecular Weight)] * 100 where Molecular Weight is calculated based on Kinematic Viscosity at 100° C. and 40° C. of the 700° F.+ Lube.

TABLE 5

| Preliminary Lube Basestock Specifications | 130N* |
|---|---|
| Integrated 700° F.+ Lube Yield (wt %) (R1-R2) at Total Liquid Product Pour Point of −20° C. | 69 |
| Dewaxing 700° F.+ Lube Yield (wt %) (R2) at Total Liquid Product Pour Point of −20° C. | 89 |
| 700° F.+ Lube Pour Point, ° C. | −22 |
| 700° F.+ Lube 100° C. Viscosity, cSt | 4 |
| 700° F.+ Lube VI | 114 |
| 700° F.+ Lube % Saturates (wt %)** | 96 |

*Reactor pressure = 1000 psig

**% Saturates (wt %) = [1 − (Total Aromatics of 700° F.+ Lube (moles/gram) * Calculated Molecular Weight)] * 100 where Molecular Weight is calculated based on Kinematic Viscosity at 100° C. and 40° C. of the 700° F.+ Lube.

Figure 8:
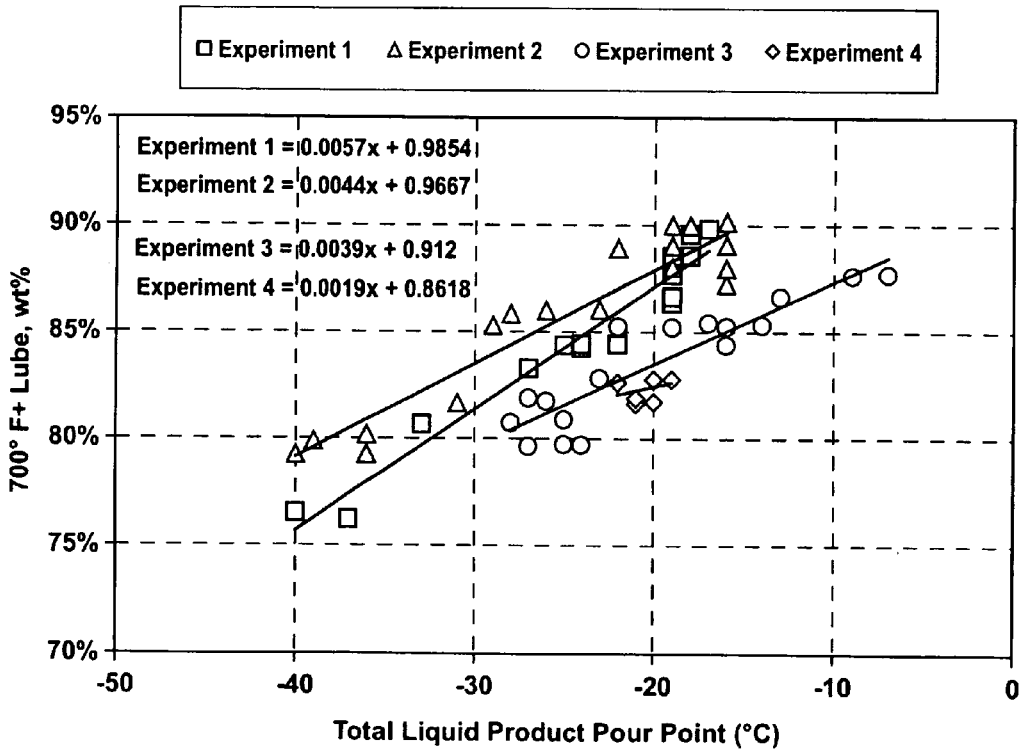
FIG. 8 shows lube yield versus total liquid product pour point for various catalysts for Experiments 1-4 disclosed herein.
Figure 9:
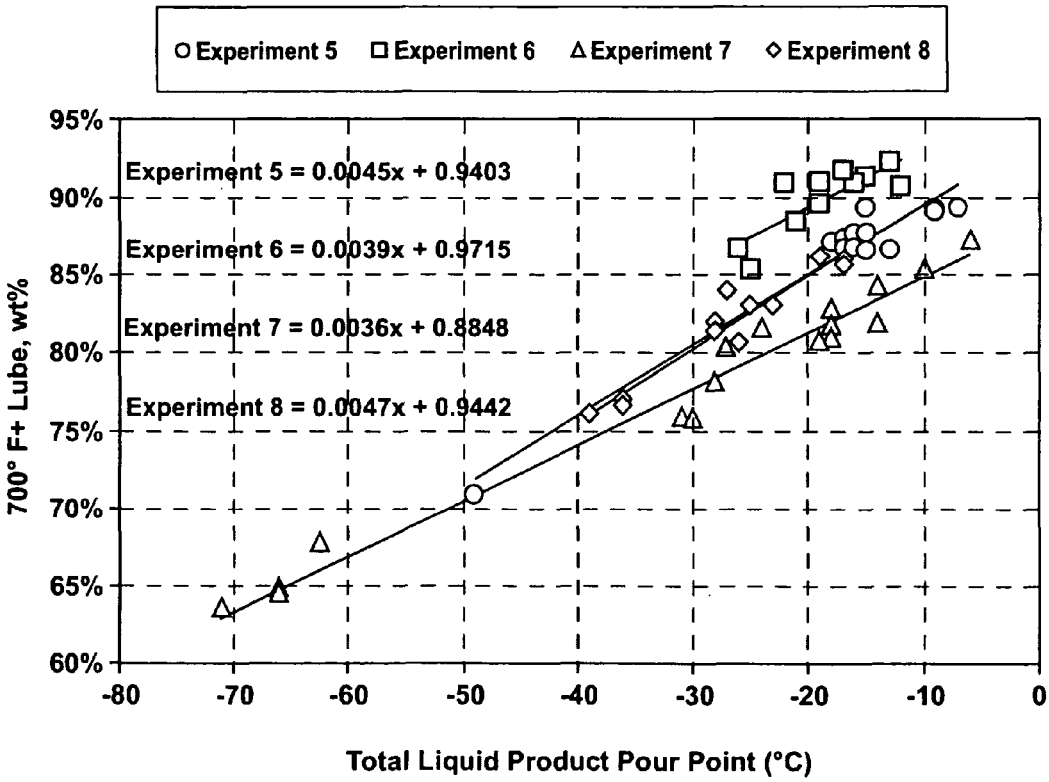
FIG. 9 shows lube yield versus total liquid product pour point for various catalysts for Experiments 5-8 disclosed herein.
Figure 10:
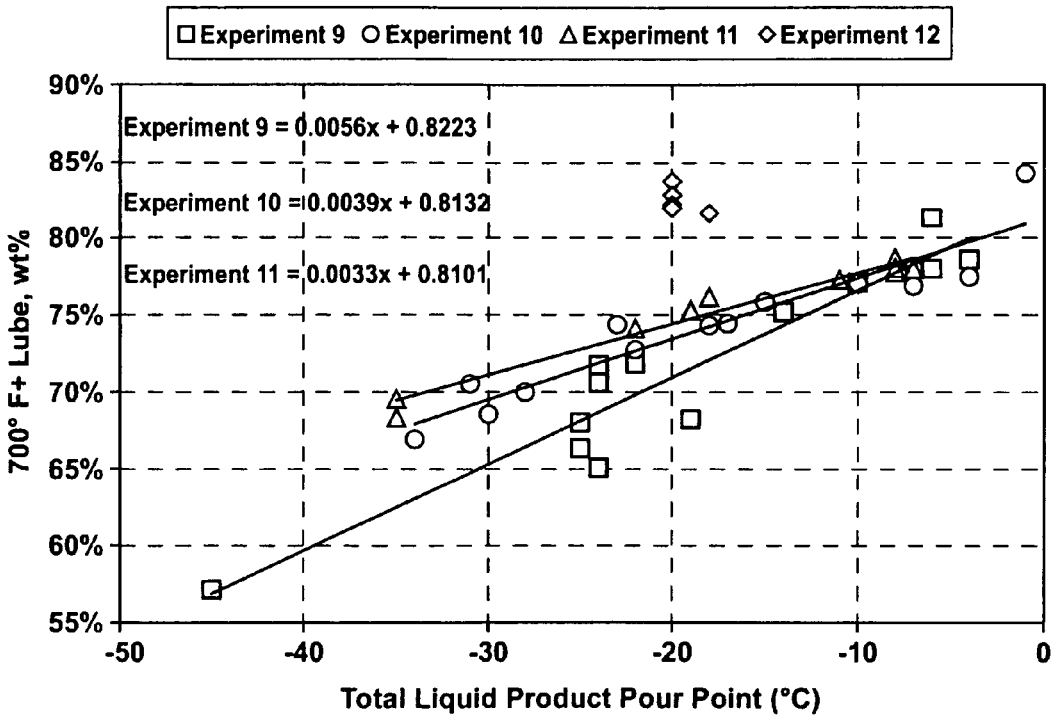
FIG. 10 shows lube yield versus total liquid product pour point for various catalysts for Experiments 9-12 disclosed herein

FIGS. 8, 9 and 10 demonstrate the total liquid product pour point versus yield characteristics for the experimental conditions shown above over a broader range of pour points. More particularly, FIG. 8 shows yield versus total liquid product pour point for the various catalysts used in Experiments 1-4 above. FIG. 9 shows yield versus total liquid product pour point for the various catalysts used Experiments 5-8 above. FIG. 10 shows yield versus total liquid product pour point for the various catalysts used in Experiments 9-12 above.

Figure 11:
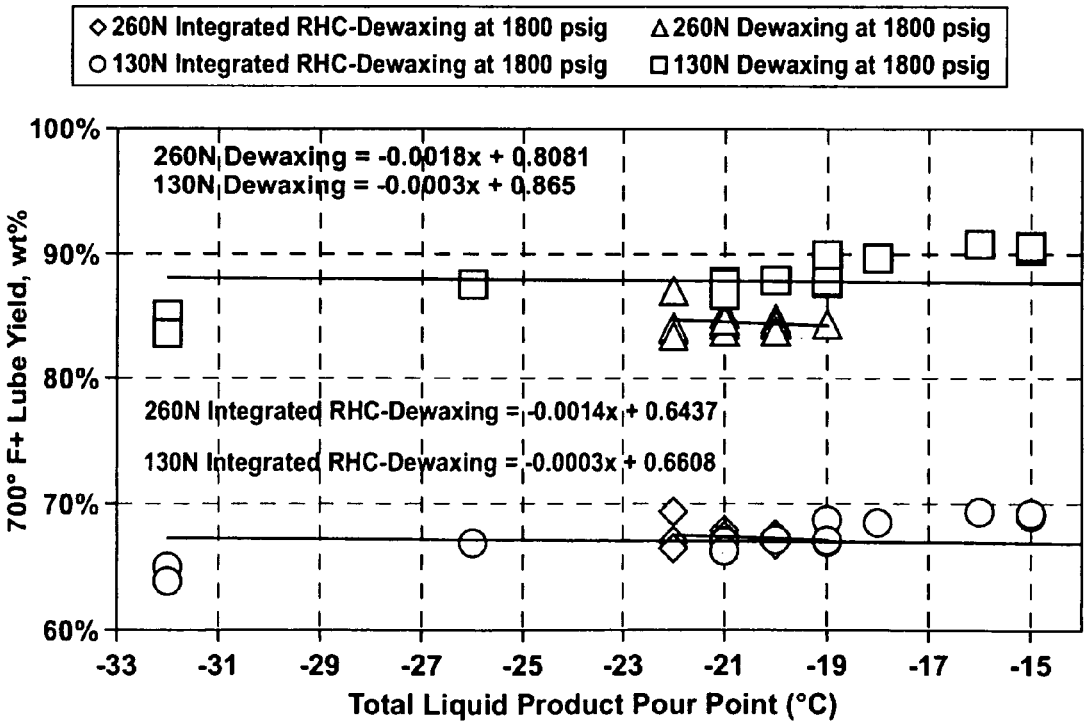
FIG. 11 shows lube yield versus total liquid product pour point for an integrated raffinate hydroconversion—dewaxing process for 260N and 130N raffinates at 1800 psig reactor pressure.
Figure 12:
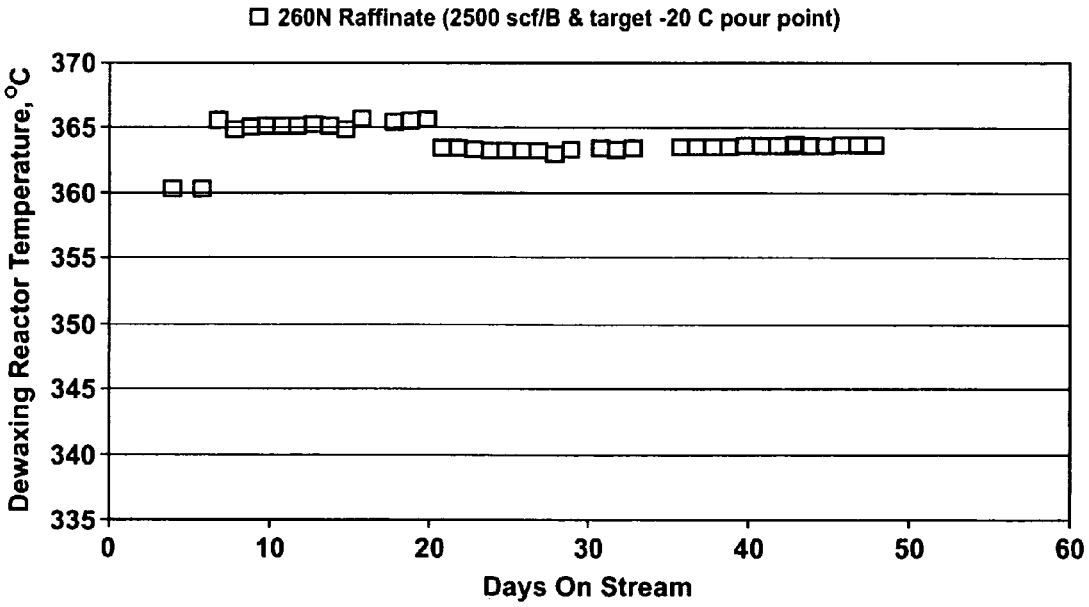
FIG. 12 shows dewaxing reactor temperature versus days on stream for an integrated raffinate hydroconversion—dewaxing process for a 260N raffinate.

FIG. 11 shows the integrated lube yield versus total liquid product pour point for an integrated raffinate hydroconversion—dewaxing process at 1800 psig using 260N and 130N raffinate feedstocks relative to the processes depicted in FIGS. 6 and 13. FIG. 11 further shows the dewaxing lube yield versus total liquid product pour point across the dewaxing reactor. The experimental results of lube yield versus total liquid product pour point shows that dewaxing yields under sour service conditions are similar to clean service dewaxing yields. FIG. 12 shows dewaxing reactor temperature versus days on stream for an integrated raffinate hydroconversion—dewaxing process for a 260N raffinate relative to the processes depicted in FIGS. 6 and 13. The experimental results show that there is no sign of aging of the dewaxing catalyst under sour service conditions.

Figure 14:
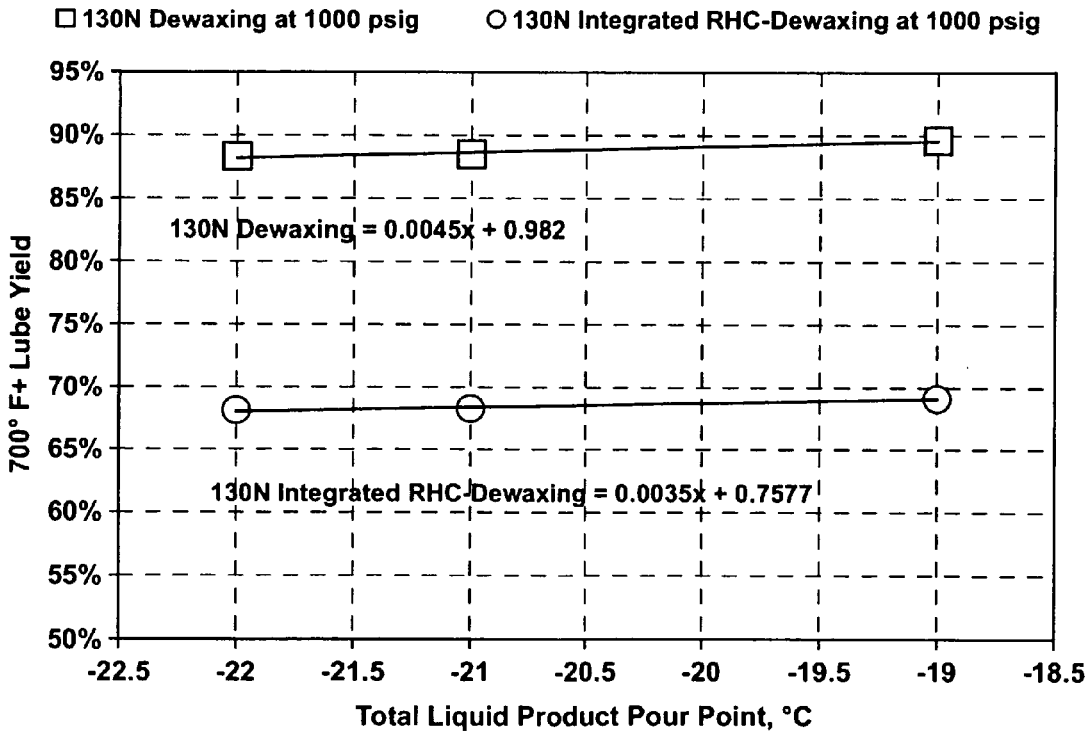
FIG. 14 shows lube yield versus total liquid product pour point for an integrated raffinate hydroconversion—dewaxing process for a 130N raffinate at 1000 psig reactor pressure.

FIG. 14 shows the integrated lube yield versus total liquid product pour point for an integrated raffinate hydroconversion—dewaxing process at 1000 psig using a 130N raffinate feedstock relative to the processes depicted in FIGS. 6 and 13 except no hydrofinishing took place. FIG. 14 further shows the dewaxing lube yield versus total liquid product pour point across the dewaxing reactor. The experimental results of lube yield versus total liquid product pour point shows that dewaxing yields under sour service conditions are similar to clean service dewaxing yields.

Dewaxing Catalyst Synthesis

In one form the of the present disclosure, the catalytic dewaxing catalyst includes from 0.1 wt % to 2.7 wt % framework alumina, 0.1 wt % to 5 wt % Pt, 200:1 to 30:1 $SiO_2$:$Al_2O_3$ ratio and at least one low surface area, refractory metal oxide binder with a surface area of 100 $m^2/g$ or less.

One example of a molecular sieve suitable for use in the claimed invention is ZSM-48 with a $SiO_2$:$Al_2O_3$ ratio of less than 110, preferably from about 70 to about 110. In the embodiments below, ZSM-48 crystals will be described variously in terms of "as-synthesized" crystals that still contain the (200:1 or less $SiO_2$:$Al_2O_3$ ratio) organic template; calcined crystals, such as Na-form ZSM-48 crystals; or calcined and ion-exchanged crystals, such as H-form ZSM-48 crystals.

The ZSM-48 crystals after removal of the structural directing agent have a particular morphology and a molar composition according to the general formula:

$$(n)SiO_2:Al_2O_3$$

where n is from 70 to 110, preferably 80 to 100, more preferably 85 to 95. In another embodiment, n is at least 70, or at least 80, or at least 85. In yet another embodiment, n is 110 or less, or 100 or less, or 95 or less. In still other embodiments, Si may be replaced by Ge and Al may be replaced by Ga, B, Fe, Ti, V, and Zr.

The as-synthesized form of ZSM-48 crystals is prepared from a mixture having silica, alumina, base and hexamethonium salt directing agent. In an embodiment, the molar ratio of structural directing agent:silica in the mixture is less than 0.05, or less than 0.025, or less than 0.022. In another embodiment, the molar ratio of structural directing agent:silica in the mixture is at least 0.01, or at least 0.015, or at least 0.016. In still another embodiment, the molar ratio of structural directing agent:silica in the mixture is from 0.015 to 0.025, preferably 0.016 to 0.022. In an embodiment, the as-synthesized form of ZSM-48 crystals has a silica:alumina molar ratio of 70 to 110. In still another embodiment, the as-synthesized form of ZSM-48 crystals has a silica:alumina molar ratio of at least 70, or at least 80, or at least 85. In yet another embodiment, the as-synthesized form of ZSM-48 crystals has a silica:alumina molar ratio of 110 or less, or 100 or less, or 95 or less. For any given preparation of the as-synthesized form of ZSM-48 crystals, the molar composition will contain silica, alumina and directing agent. It should be noted that the as-synthesized form of ZSM-48 crystals may have molar ratios slightly different from the molar ratios of reactants of the reaction mixture used to prepare the as-synthesized form. This result may occur due to incomplete incorporation of 100% of the reactants of the reaction mixture into the crystals formed (from the reaction mixture).

The ZSM-48 composition is prepared from an aqueous reaction mixture comprising silica or silicate salt, alumina or soluble aluminate salt, base and directing agent. To achieve the desired crystal morphology, the reactants in reaction mixture have the following molar ratios:

$SiO_2:Al_2O_3$ (preferred)=70 to 110

$H_2O:SiO_2$=1 to 500

OH—:$SiO_2$=0.1 to 0.3

OH—:$SiO_2$ (preferred)=0.14 to 0.18 template:$SiO_2$=0.01-0.05 template:$SiO_2$ (preferred)=0.015 to 0.025

In the above ratios, two ranges are provided for both the base:silica ratio and the structure directing agent:silica ratio. The broader ranges for these ratios include mixtures that result in the formation of ZSM-48 crystals with some quantity of Kenyaite and/or needle-like morphology. For situations where Kenyaite and/or needle-like morphology is not desired, the preferred ranges should be used, as is further illustrated below in the Examples.

The silica source is preferably precipitated silica and is commercially available from Degussa. Other silica sources include powdered silica including precipitated silica such as Zeosil® and silica gels, silicic acid colloidal silica such as Ludox® or dissolved silica. In the presence of a base, these other silica sources may form silicates. The alumina may be in the form of a soluble salt, preferably the sodium salt and is commercially available from US Aluminate. Other suitable aluminum sources include other aluminum salts such as the chloride, aluminum alcoholates or hydrated alumina such as gamma alumina, pseudobohemite and colloidal alumina. The base used to dissolve the metal oxide can be any alkali metal hydroxide, preferably sodium or potassium hydroxide, ammonium hydroxide, diquaternary hydroxide and the like. The directing agent is a hexamethonium salt such as hexamethonium dichloride or hexamethonium hydroxide. The anion (other than chloride) could be other anions such as hydroxide, nitrate, sulfate, other halide and the like. Hexamethonium dichloride is N,N,N,N',N',N'-hexamethyl-1,6-hexanediammonium dichloride.

In an embodiment, the crystals obtained from the synthesis according to the invention have a morphology that is free of fibrous morphology. Fibrous morphology is not desired, as this crystal morphology inhibits the catalytic dewaxing activity of ZSM-48. In another embodiment, the crystals obtained from the synthesis according to the invention have a morphology that contains a low percentage of needle-like morphology. The amount of needle-like morphology present in the ZSM-48 crystals can be 10% or less, or 5% or less, or 1% or less. In an alternative embodiment, the ZSM-48 crystals can be free of needle-like morphology. Low amounts of needle-like crystals are preferred for some applications as needle-like crystals are believed to reduce the activity of ZSM-48 for some types of reactions. To obtain a desired morphology in high purity, the ratios of silica:alumina, base:silica and directing agent:silica in the reaction mixture according to embodiments of the invention should be employed. Additionally, if a composition free of Kenyaite and/or free of needle-like morphology is desired, the preferred ranges should be used.

The as-synthesized ZSM-48 crystals should be at least partially dried prior to use or further treatment. Drying may be accomplished by heating at temperatures of from 100 to 400° C., preferably from 100 to 250° C. Pressures may be atmospheric or subatmospheric. If drying is performed under partial vacuum conditions, the temperatures may be lower than those at atmospheric pressures.

Catalysts are typically bound with a binder or matrix material prior to use. Binders are resistant to temperatures of the use desired and are attrition resistant. Binders may be catalytically active or inactive and include other zeolites, other inorganic materials such as clays and metal oxides such as alumina, silica, titania, zirconia, and silica-alumina. Clays may be kaolin, bentonite and montmorillonite and are commercially available. They may be blended with other materials such as silicates. Other porous matrix materials in addition to silica-aluminas include other binary materials such as silica-magnesia, silica-thoria, silica-zirconia, silica-beryllia and silica-titania as well as ternary materials such as silica-alumina-magnesia, silica-alumina-thoria and silica-alumina-zirconia. The matrix can be in the form of a co-gel. The bound ZSM-48 framework alumina will range from 0.1 wt % to 2.7 wt % framework alumina.

ZSM-48 crystals as part of a catalyst may also be used with a metal hydrogenation component. Metal hydrogenation components may be from Groups 6-12 of the Periodic Table based on the IUPAC system having Groups 1-18, preferably Groups 6 and 8-10. Examples of such metals include Ni, Mo, Co, W, Mn, Cu, Zn, Ru, Pt or Pd, preferably Pt or Pd. Mixtures of hydrogenation metals may also be used such as Co/Mo, Ni/Mo, Ni/W and Pt/Pd, preferably Pt/Pd. The amount of hydrogenation metal or metals may range from 0.1 to 5 wt. %, based on catalyst. In an embodiment, the amount of metal or metals is at least 0.1 wt %, or at least 0.25 wt %, or at least 0.5 wt %, or at least 0.6 wt %, or at least 0.75 wt %, or at least 0.9 wt %. In another embodiment, the amount of metal or metals is 5 wt % or less, or 4 wt % or less, or 3 wt % or less, or 2 wt % or less, or 1 wt % or less. Methods of loading metal onto ZSM-48 catalyst are well known and include, for example, impregnation of ZSM-48 catalyst with a metal salt of the hydrogenation component and heating. The ZSM-48 catalyst containing hydrogenation metal may also be sulfided prior to use.

High purity ZSM-48 crystals made according to the above embodiments have a relatively low silica:alumina ratio. This lower silica:alumina ratio means that the present catalysts are more acidic. In spite of this increased acidity, they have superior activity and selectivity as well as excellent yields. They also have environmental benefits from the standpoint of health effects from crystal form and the small crystal size is also beneficial to catalyst activity.

For catalysts according to the invention that incorporate ZSM-23, any suitable method for producing ZSM-23 with a low $SiO_2:Al_2O_3$ ratio may be used. U.S. Pat. No. 5,332,566 provides an example of a synthesis method suitable for producing ZSM-23 with a low ratio of $SiO_2:Al_2O_3$. For example, a directing agent suitable for preparing ZSM-23 can be formed by methylating iminobispropylamine with an excess of iodomethane. The methylation is achieved by adding the iodomethane dropwise to iminobispropylamine which is solvated in absolute ethanol. The mixture is heated to a reflux temperature of 77° C. for 18 hours. The resulting solid product is filtered and washed with absolute ethanol.

The directing agent produced by the above method can then be mixed with colloidal silica sol (30% $SiO_2$), a source of alumina, a source of alkali cations (such as Na or K), and deionized water to form a hydrogel. The alumina source can be any convenient source, such as alumina sulfate or sodium aluminate. The solution is then heated to a crystallization temperature, such as 170° C., and the resulting ZSM-23 crystals are dried. The ZSM-23 crystals can then be combined with a low surface area binder to form a catalyst according to the invention.

CATALYST EXAMPLES

Catalyst Example 1

0.6 wt % Pt(IW) on 65/35 ZSM-48(90/1 $SiO_2$:$Al_2O_3$)/$TiO_2$

65% ZSM-48(90/1 $SiO_2$:$Al_2O_3$) and 35% Titania were extruded to a 1/16" quadrulobe. The extrudate was pre-calcined in $N_2$ @1000° F., ammonium exchanged with 1N ammonium nitrate, and then dried at 250° F., followed by calcination in air at 1000° F. The extrudate was then was loaded with 0.6 wt % Pt by incipient wetness impregnation with platinum tetraammine nitrate, dried at 250° F., and calcined in air at 680° F. for 3 hours. Table 6 provides the surface area of the extrudate via $N_2$ porosimetry.

A batch micro-autoclave system was used to determine the activity of the above catalyst. The catalyst was reduced under hydrogen followed by the addition of 2.5 grams of a 130N feed (cloud point 31). The reaction was run at 400 psig at 330° C. for 12 hours. Cloud points were determined for two feed space velocities. Results are provided in Table 7.

Catalyst Example 2

0.6 wt % Pt(IW) on 65/35 ZSM-48(90/1 $SiO_2$:$Al_2O_3$)/$Al_2O_3$ (Comparative)

65% ZSM-48(90/1 $SiO_2$:$Al_2O_3$) and 35% Versal-300 $Al_2O_3$ were extruded to a 1/16" quadrulobe. The extrudate was pre-calcined in $N_2$ @1000° F., ammonium exchanged with 1N ammonium nitrate, and then dried at 250° F. followed by calcination in air at 1000° F. The extrudate was then steamed (3 hours at 890° F.). The extrudate was then loaded with 0.6 wt % Pt by incipient wetness impregnation with platinum tetraammine nitrate, dried at 250° F., and calcined in air at 680° F. for 3 hours. Table 6 provides the surface area of the extrudate via $N_2$ porosimetry.

A batch micro-autoclave system was used to determine the activity of the above catalyst. The catalyst was reduced under hydrogen followed by the addition of 2.5 grams of a 130N feed. The reaction was run at 400 psig at 330° C. for 12 hours. Cloud points were determined for two feed space velocities. Results are provided in Table 7.

Catalyst Example 3

0.6 wt % Pt (IW) on 80/20 ZSM-48(90/1 $SiO_2$:$Al_2O_3$)/$SiO_2$

80% ZSM-48(90/1 $SiO_2$:$Al_2O_3$) and 20% $SiO_2$ were extruded to 1/16" quadrulobe. The extrudate was pre-calcined in $N_2$ @1000° F., ammonium exchanged with 1N ammonium nitrate, and then dried at 250° F. followed by calcination in air at 1000° F. The extrudate was then loaded with 0.6 wt % Pt by incipient wetness impregnation with platinum tetraammine nitrate, dried at 250° F., and calcined in air at 680° F. for 3 hours. Table 6 provides the surface area of the extrudate via $N_2$ porosimetry.

A batch micro-autoclave system was used to determine the activity of the above catalyst. The catalyst was reduced under hydrogen followed by the addition of 2.5 grams 130N. The reaction was run at 400 psig at 330° C. for 12 hours. Cloud points were determined for two feed space velocities. Results are provided in Table 7.

Catalyst Example 4

0.6 wt % Pt (IW) on 65/35 ZSM-48(90/1 $SiO_2$:$Al_2O_3$)/Theta-Alumina

Pseudobohemite alumina was calcined at 1000° C. to convert it to a lower surface area theta phase, as compared to the gamma phase alumina used as the binder in Example 2 above. 65% of ZSM-48(90/1 $SiO_2$:$Al_2O_3$) and 35% of the calcined alumina were extruded with 0.25% PVA to 1/16" quadrulobes. The extrudate was pre-calcined in $N_2$ at 950° F., ammonium exchanged with 1N ammonium nitrate, and then dried at 250° F. followed by calcination in air at 1000° F. The extrudate was then loaded with 0.6 wt % Pt by incipient wetness impregnation with platinum tetraammine nitrate, dried at 250° F., and calcined in air at 680° F. for 3 hours. Table 6 provides the surface area of the extrudate via $N_2$ porosimetry.

A batch micro-autoclave system was used to determine the activity of the above catalyst. The catalyst was reduced under hydrogen followed by the addition of 2.5 grams 130N. The reaction was run at 400 psig at 330° C. for 12 hours. Cloud points were determined for two feed space velocities. Results are provided in Table 7.

Catalyst Example 5

0.6 wt % Pt(IW) on 65/35 ZSM-48 (90/1 $SiO_2$:$Al_2O_3$)/Zirconia

65% ZSM-48(90/1 $SiO_2$:$Al_2O_3$) and 35% Zirconia were extruded to a 1/16" quadrulobe. The extrudate was pre-calcined in N2 @1000° F., ammonium exchanged with 1N ammonium nitrate, and then dried at 250° F. followed by calcination in air at 1000° F. The extrudate was then was loaded with 0.6 wt % Pt by incipient wetness impregnation with platinum tetraammine nitrate, dried at 250° F., and calcined in air at 680° F. for 3 hours. Table 6 provides the surface area of the extrudate via $N_2$ porosimetry.

A batch micro-autoclave system was used to determine the activity of the above catalyst. The catalyst was reduced under hydrogen followed by the addition of 2.5 grams 130N. The reaction was run at 400 psig at 330° C. for 12 hours. Cloud points were determined for two feed space velocities. Results are provided in Table 7.

TABLE 6

| Example | | BET Total SA ($m^2/g$) | Micropore SA ($m^2/g$) | Micropore SA/BET Total SA ($m^2/g$) |
|---|---|---|---|---|
| 1 | 0.6% Pt on 65/35 ZSM-48 (90/1 $SiO_2$:$Al_2O_3$)/P25 $TiO_2$ | 200 | 95 | 48 |
| 2 | 0.6% Pt on 65/35 ZSM-48 (90/1 $SiO_2$:$Al_2O_3$)/Versal-300 $Al_2O_3$ | 232 | 50 | 22 |

TABLE 6-continued

| Example | | BET Total SA ($m^2/g$) | Micropore SA ($m^2/g$) | Micropore SA/BET Total SA ($m^2/g$) |
|---|---|---|---|---|
| 3 | 0.6% Pt on 80/20 ZSM-48 (90/1 $SiO_2$:$Al_2O_3$)/Silica | 211 | 114 | 54 |
| 4 | 0.6% Pt on 65/35 ZSM-48 (90/1 $SiO_2$:$Al_2O_3$)/Theta-alumina | 238 | 117 | 49 |
| 5 | 0.6% Pt on 65/35 ZSM-48 (90/1 $SiO_2$:$Al_2O_3$)/Zirconia | 225 | 128 | 57 |

Table 6 shows that the catalysts from Catalyst Examples 1, 3, 4, and 5 all have a ratio of micropore surface area to BET total surface area of 25% or more.

TABLE 7

| | WHSV | Cloud Point (° C.) |
|---|---|---|
| 1 | 0.71 | −45* |
| 1 | 1.03 | −35 |
| 2 | 0.75 | −26 |
| 2 | N/A | N/A |
| 3 | 0.71 | −45* |
| 3 | 1.01 | −28 |
| 4 | 0.73 | −45* |
| 4 | 1.03 | −12 |
| 5 | 0.73 | −45* |
| 5 | 0.99 | −45* |

Note that in Table 7, a value of −45° C. represents the low end of the measurement range for the instrument used to measure the cloud point. Cloud point measurements indicated with an asterisk are believed to represent the detection limit of the instrument, rather than the actual cloud point value of the processed feed. As shown in Table 6, all of the catalysts with a ratio of micropore surface area to BET total surface area of 25% or more, produced a product with the lowest detectable cloud point at a space velocity near 0.75. By contrast, the catalyst from Catalyst Example 2, a ratio of micropore surface area to BET total surface area of less than 25%, produced a cloud point of only −26° C. for a space velocity near 0.75. Note that the alumina used to form the catalyst in Example 2 also corresponds to high surface area binder of greater than 100 $m^2/g$. At the higher space velocity of about 1.0, all of the low surface area binder catalysts also produced good results.

Catalyst Example 6

Hydrodewaxing Catalysts with High Silica to Alumina Ratios (Comparative)

Additional catalyst evaluations were carried out on comparative catalysts having a zeolite with a high silica to alumina ratio. A catalyst of 0.6 wt % Pt on 65/35 ZSM-48 (180/1 $SiO_2$:$Al_2O_3$)/P25 $TiO_2$ was prepared according to the following procedure. A corresponding sample was also prepared using $Al_2O_3$ instead of $TiO_2$, which produced a catalyst of 0.6 wt % Pt on 65/35 ZSM-48 (180/1 $SiO_2$:$Al_2O_3$)/Versal-300 $Al_2O_3$.

An extrudate consisting of 65% (180/1 $SiO_2/Al_2O_3$) ZSM-48 and 35% Titania (50 grams) was loaded with 0.6 wt % Pt by incipient wetness impregnation with platinum tetraammine nitrate, dried at 250° F. and calcined in full air at 680° F. for 3 hours. As shown above in Table 5, the TiO2 binder provides a formulated catalyst with a high ratio of zeolite surface area to external surface area. The $TiO_2$ binder also provides a lower acidity than an $Al_2O_3$ binder.

The above two catalysts were used for hydrodewaxing experiments on a multi-component model compound system designed to model a 130N raffinate. The multi-component model feed was made of 40% n-hexadecane in a decalin solvent with 0.5% dibenzothiophene (DBT) and 100 ppm N in quinoline added (bulky S, N species to monitor HDS/HDN). The feed system was designed to simulate a real waxy feed composition.

Hydrodewaxing studies were performed using a continuous catalyst testing unit composed of a liquid feed system with an ISCO syringe pump, a fixed-bed tubular reactor with a three-zone furnace, liquid product collection, and an on-line MTI GC for gas analysis. Typically, 10 cc of catalyst was sized and charged in a down-flow ⅜" stainless steel reactor containing a ⅛" thermowell. After the unit was pressure tested, the catalyst was dried at 300° C. for 2 hours with 250 cc/min $N_2$ at ambient pressure. The catalysts were then reduced by hydrogen reduction. Upon completion of the catalyst treatment, the reactor was cooled to 150° C., the unit pressure was set to 600 psig by adjusting a back-pressure regulator and the gas flow was switched from $N_2$ to $H_2$. Liquid feedstock was introduced into the reactor at 1 liquid hourly space velocity (LHSV). Once the liquid feed reached the downstream knockout pot, the reactor temperature was increased to the target value. A material balance was initiated until the unit was lined out for 6 hours. The total liquid product was collected in the material balance dropout pot and analyzed by an HP 5880 gas chromatograph (GC) with FID. The detailed aromatic component conversion and products were identified and calculated by GC analysis. Gas samples were analyzed with an on-line HP MTI GC equipped with both TCD and FID detectors. A series of runs were performed to understand catalyst activity/product properties as function of process temperature.

All catalysts were loaded in an amount of 10 cc in the reactor and were evaluated using the operating procedure described in Catalyst Example 6 above at the following conditions: T=270-380° C., P=600 psig, liquid rate=10 cc/hr, $H_2$ circulation rate=2500 scf/B and LHSV=1 $hr^{-1}$.

Figure 2:
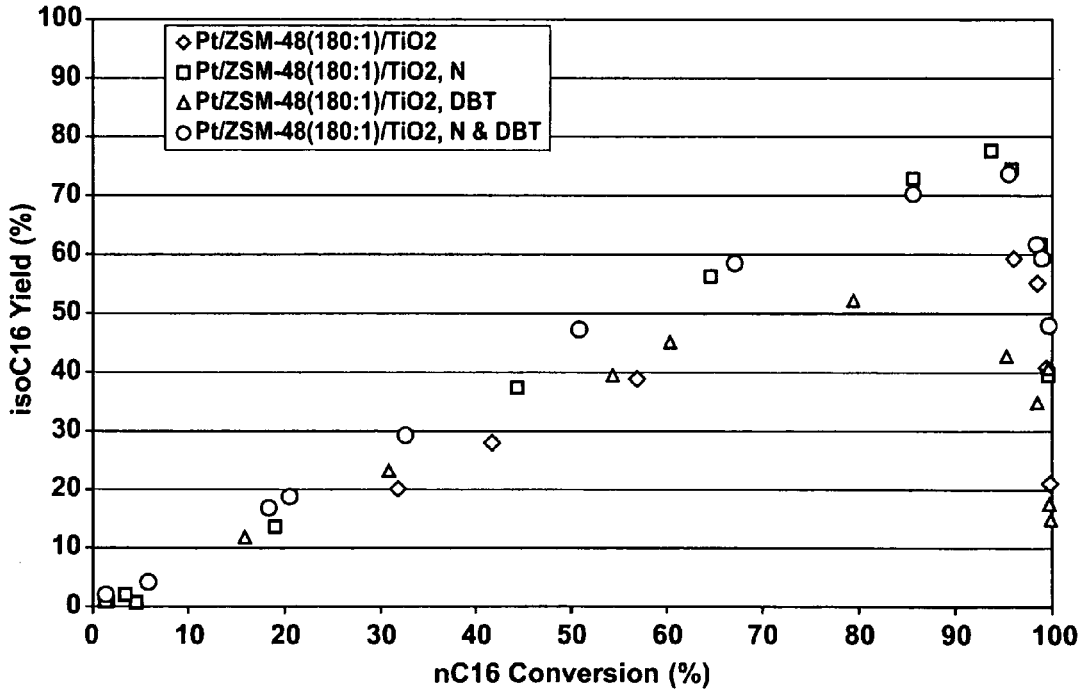

The n-hexadecane ($nC_{16}$) isomerization activity and yield are summarized in FIGS. 1 and 2. FIG. 1 shows the relationship between $nC_{16}$ conversion and iso-$C_{16}$ yield for a clean feed and spiked feeds for the alumina bound (higher surface area) catalyst. FIG. 2 shows similar relationships for the titania bound (lower surface area) catalyst. In general, the catalysts with higher and lower surface area binders show similar conversion efficiency. The low surface area catalyst (FIG. 2) has slightly lower conversion efficiencies relative to yield as compared to the higher surface area catalyst. For each of these feeds, the temperatures needed to achieve a given $nC_{16}$ conversion level were similar for the two types of catalyst.

Catalyst Example 7

Hydrodewaxing Over 0.6 wt % Pt on 65/35 ZSM-48 (90/1)/$TiO_2$ using 130N Feed This example illustrates the catalytic performance of 0.6 wt % Pt on 65/35 ZSM-48(90/1 $SiO_2/Al_2O_3$)/$TiO_2$ versus a corresponding alumina-bound (higher external surface area) catalyst using 130N raffinate.

An extrudate consisting of 65% (90/1 $SiO_2/Al_2O_3$) ZSM-48 and 35% Titania (30 grams) was loaded with 0.6 wt % Pt by incipient wetness impregnation with platinum tetraammine nitrate, dried at 250° F. and calcined in full air at 680° F. for 3 hours. A corresponding sample was also prepared using $Al_2O_3$ instead of $TiO_2$.

The catalysts were loaded in a 10 cc amount in the reactor and were evaluated using the operating procedure described in Catalyst Example 6 at the following conditions: T=330-380° C., P=400 psig, liquid rate=5 cc/hr, $H_2$ circulation rate=5000 scf/B, and LHSV=0.5 hr. The catalysts were exposed to the 130N raffinate which contained 66 ppm nitrogen by weight and 0.63 wt % sulfur.

Figure 3:
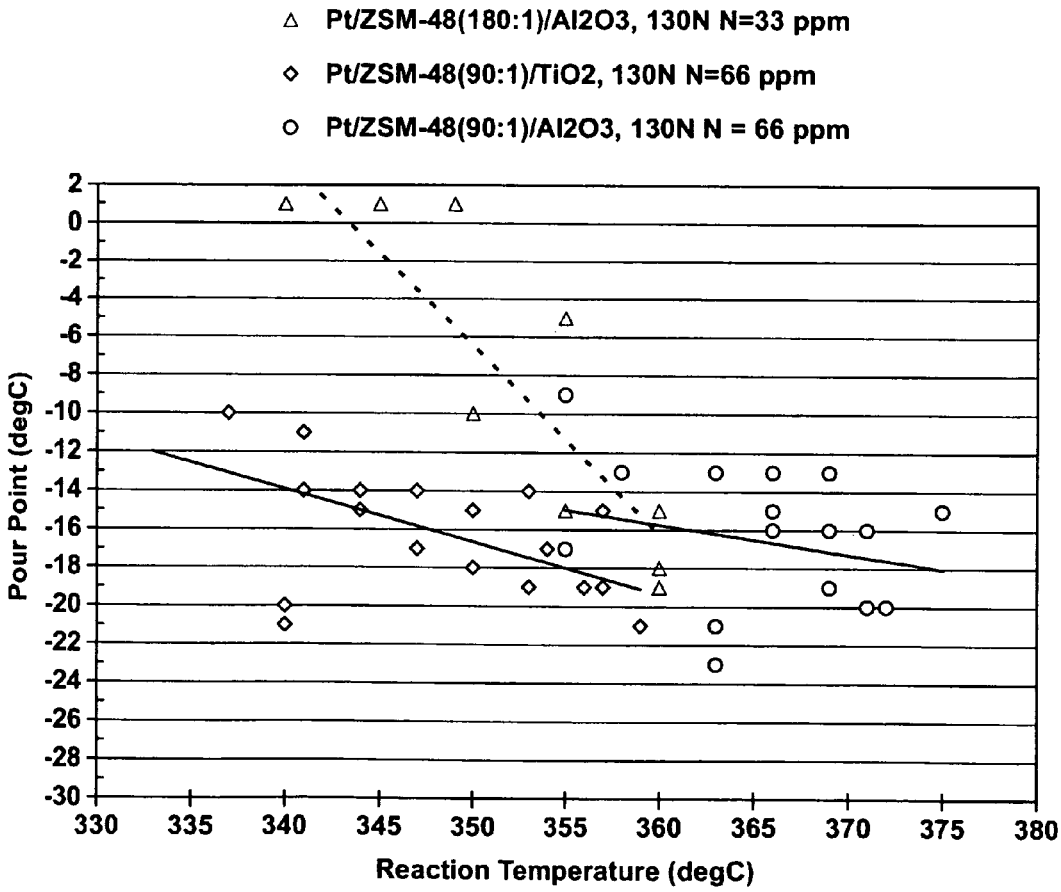
FIG. 3 shows the activity as a correlation between hydroprocessing temperature and pour point for various catalysts.

FIG. 3 shows the relative catalyst activity of the 0.6 wt % Pt on 65/35 ZSM-48(90/1 $SiO_2/Al_2O_3$)/$TiO_2$ catalyst and the corresponding alumina bound catalyst. For the 130N raffinate feed, compared with the corresponding alumina bound catalyst, the 0.6 wt % Pt on 65/35 ZSM-48(90/1 $SiO_2/Al_2O_3$)/$TiO_2$ catalyst showed a 20° C. temperature advantage (i.e. more active at 20° C. lower temp) at the given product pour point. Note that FIG. 3 also shows data for a 130N raffinate feed with half the nitrogen content that was hydroprocessed using 65/35 ZSM-48 (180/1 $SiO_2/Al_2O_3$)/$Al_2O_3$ with 0.6 wt % Pt. (This is the alumina bound catalyst from Catalyst Example 6.) Even at twice the nitrogen content, the lower surface area 65/35 ZSM-48(90/1 $SiO_2/Al_2O_3$)/$TiO_2$ with 0.6 wt % Pt catalyst achieved a substantial activity credit.

Figure 4:
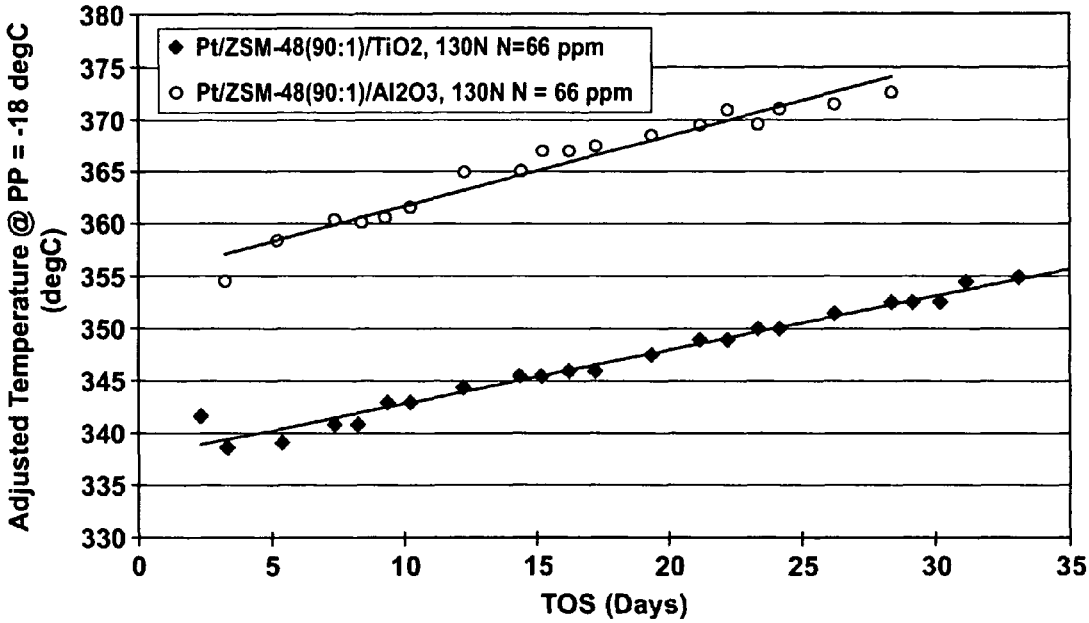
FIG. 4 shows an aging rate for various catalysts.

To further demonstrate the benefit of the low surface area, low silica to alumina ratio catalyst, FIG. 4 shows a TIR plot for the 0.6 wt % Pt on 65/35 ZSM-48(90/1 $SiO_2/Al_2O_3$)/$TiO_2$ catalyst and the corresponding alumina-bound catalyst. The TIR plot shows that the aging rate for the 0.6 wt % Pt on 65/35 ZSM-48(90/1 $SiO_2/Al_2O_3$)/$TiO_2$ catalyst was 0.624° C./day compared to 0.69° C./day for the corresponding alumina-bound catalyst. Thus, when exposed to a nitrogen rich feed, the low surface area and low silica to alumina ratio catalyst provides both improved activity and longer activity lifetime.

Figure 5:
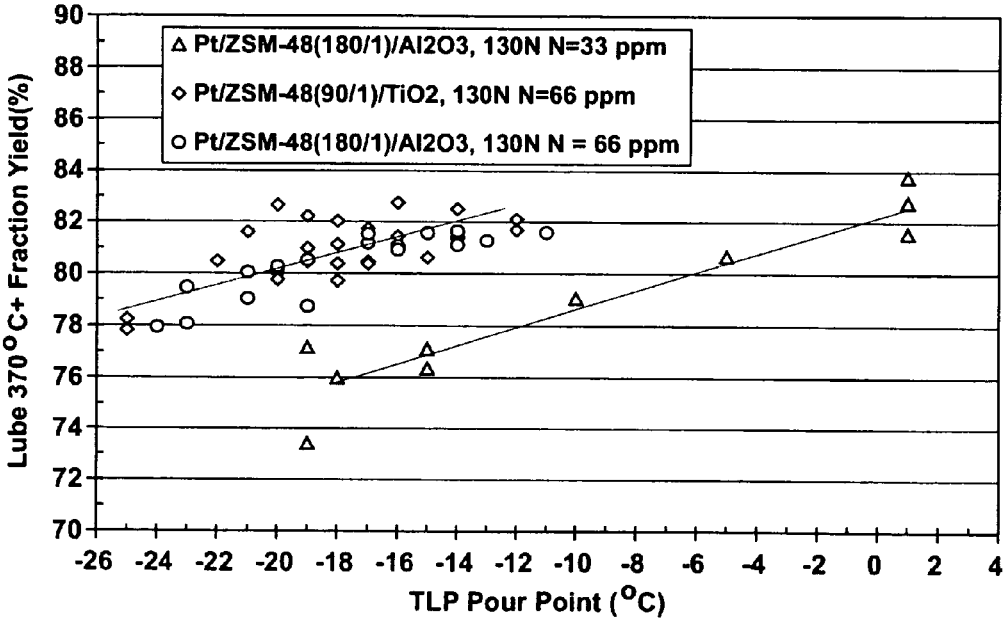
FIG. 5 shows the hydroprocessing product yield versus pour point for various catalysts.

FIG. 5 provides the lubricant yield for the 0.6 wt % Pt on 65/35 ZSM-48(90/1 $SiO_2/Al_2O_3$)/$TiO_2$ catalyst and the two alumina bound catalysts shown in FIG. 3. The 0.6 wt % Pt on 65/35 ZSM-48(90/1 $SiO_2/Al_2O_3$)/$TiO_2$ provides the same lubricant yield as the corresponding alumina-bound (higher surface area) catalyst. The VI versus pour point relationships for the lower and higher surface area catalysts are also similar. Note that both the 0.6 wt % Pt on 65/35 ZSM-48(90/1 $SiO_2/Al_2O_3$)/$TiO_2$ catalyst and the corresponding alumina catalyst provided an improved pour point versus yield relationship as compared to the higher silica to alumina ratio catalyst.

Catalyst Example 8

Mixed Binder Systems

This example illustrates that the advantage of a low surface area binder can be realized for mixed binder systems, where a majority of the binder is a low surface area binder.

An extrudate consisting of 65% (90/1 $SiO_2/Al_2O_3$) ZSM-48 and 35% of a mixed binder was loaded with 0.6 wt % Pt by incipient wetness impregnation with platinum tetraammine nitrate, dried at 250° F. and calcined in full air at 680° F. for 3 hours. The 35 wt % binder in the extrudate was composed of 20 wt % alumina (higher surface area) and 15 wt % titania (lower surface area).

A second extrudate consisting of 65% (90/1 $SiO_2/Al_2O_3$) ZSM-48 and 35% of a mixed binder was also loaded with 0.6 wt % Pt by incipient wetness impregnation with platinum tetraammine nitrate, dried at 250° F. and calcined in full air at 680° F. for 3 hours. In the second extrudate, the 35 wt % of binder was composed of 25 wt % titania (lower surface area) and 10 wt % alumina (higher surface area).

The activity of the above catalysts was tested in a batch micro-autoclave system. For the catalyst with a binder of 20 wt % alumina and 15 wt % titania, 208.90 mg and 71.19 mg of catalyst were loaded in separate wells and reduced under hydrogen, followed by the addition of 2.5 grams of a 600N feedstock. (The 600N feedstock had similar N and S levels to the 130N feed.) The "space velocity" was 1.04 and 3.03 respectively. The reaction was run at 400 psig at 345° C. for 12 hours. The resulting cloud point of the total liquid product was −18° C. at 1.03 WHSV and 21° C. at 3.09 WHSV.

For the catalyst with a binder of 25 wt % titania and 10 wt % alumina, 212.57 mg and 69.75 mg of catalyst were loaded in separate wells and reduced under hydrogen, followed by the addition of 2.5 grams of a 600N feedstock. (The 600N feedstock had similar N and S levels to the 130N feed.) The "space velocity" was 1.02 and 3.10 respectively. The reaction was run at 400 psig at 345° C. for 12 hours. The resulting cloud point of the total liquid product was 45° C. (detection limit of cloud point instrument) at 1.03 WHSV and 3° C. at 3.09 WHSV.

The above activity tests parallel the results from Catalyst Examples 1 to 5 above. The catalyst containing a binder composed of a majority of high surface area binder behaved similarly to the catalyst with high surface area binder in Example 2. The catalyst with a majority of low surface area binder resulted in a much more active catalyst, as seen in Catalyst Examples 1 and 3-5 above.

Applicants have attempted to disclose all embodiments and applications of the disclosed subject matter that could be reasonably foreseen. However, there may be unforeseeable, insubstantial modifications that remain as equivalents. While the present invention has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

All patents, test procedures, and other documents cited herein, including priority documents, are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated.

What is claimed is:

1. A method for producing a lubricant basestock comprising:

contacting a hydrotreated feedstock and a hydrogen containing gas with a dewaxing catalyst under effective catalytic dewaxing conditions, wherein the combined total sulfur in liquid and gaseous forms fed to the contacting step is greater than 1000 ppm by weight on the hydrotreated feedstock basis, and wherein the dewaxing catalyst includes at least one, unidimensional 10-member ring pore zeolite, at least one Group VIII metal and at least one low surface area metal oxide refractory binder, and wherein the dewaxing catalyst comprises a micropore surface area to total surface area of greater than or equal to 25%, wherein the total surface area equals the surface area of the external zeolite plus the surface area of the binder.

2. The method of claim 1 wherein the hydrotreated feedstock is chosen from a hydrocracker bottoms, a raffinate, a wax and combinations thereof.

3. The method of claim 1 wherein the hydrogen gas is chosen from a hydrotreated gas effluent, a clean hydrogen gas, a recycle gas and combinations thereof.

4. The method of claim 1, wherein the hydrotreated feedstock is hydroprocessed under effective hydroprocessing conditions chosen from hydroconversion, hydrocracking, hydrotreatment, and dealkylation.

5. The method of claim 1 further comprising hydrofinishing the dewaxed lubricant basestock under effective hydrofinishing conditions.

6. The method of claim 5 further comprising fractionating the hydrofinished, dewaxed lubricant basestock under effective fractionating conditions.

7. The method of claim 1 further comprising fractionating the dewaxed lubricant basestock under effective fractionating conditions.

8. The method of claim 7 further comprising hydrofinishing the fractionated, dewaxed lubricant basestock under effective hydrofinishing conditions.

9. The method of claim 1 wherein the hydrotreating and dewaxing steps occur in a single reactor.

10. The method of claim 1, wherein the dewaxing catalyst comprises a molecular sieve having a $SiO_2$:$Al_2O_3$ ratio of 200:1 to 30:1 and comprises from 0.1 wt % to 2.7 wt % framework $Al_2O_3$ content.

11. The method of claim 10, wherein the molecular sieve is EU-1, ZSM-35, ZSM-11, ZSM-57, NU-87, ZSM-22, EU-2, EU-11, ZBM-30, ZSM-48, ZSM-23, or a combination thereof.

12. The method of claim 10, wherein the molecular sieve is EU-2, EU-11, ZBM-30, ZSM-48 ZSM-23, or a combination thereof.

13. The method of claim 10, wherein the molecular sieve is ZSM-48, ZSM-23, or a combination thereof.

14. The method of claim 10, wherein the molecular sieve is ZSM-48.

15. The method of claim 1, wherein the metal oxide refractory binder has a surface area of 100 $m^2/g$ or less.

16. The method of claim 1, wherein the metal oxide refractory binder has a surface area of 80 $m^2/g$ or less.

17. The method of claim 1, wherein the metal oxide refractory binder has a surface area of 70 $m^2/g$ or less.

18. The method of claim 1, wherein the metal oxide refractory binder is silica, alumina, titania, zirconia, or silica-alumina.

19. The method of claim 1, wherein the metal oxide refractory binder further comprises a second metal oxide refractory binder different from the first metal oxide refractory binder.

20. The method of claim 19, wherein the second metal oxide refractory binder is silica, alumina, titania, zirconia, or silica-alumina.

21. The method of claim 1, wherein the dewaxing catalyst includes from 0.1 to 5 wt % platinum.

22. A method for producing a lubricant basestock comprising:

contacting a hydrotreated feedstock and a hydrogen containing gas with a dewaxing catalyst under effective catalytic dewaxing conditions, wherein prior to the contacting step, the effluent from the hydrotreating step is fed to at least one high pressure separator to separate the gaseous portion of the hydrotreated effluent from the liquid portion of the hydrotreated effluent, wherein the combined total sulfur in liquid and gaseous forms fed to the contacting step is greater than 1000 ppm by weight on the hydrotreated feedstock basis, and wherein the dewaxing catalyst includes at least one unidimensional 10-member ring pore zeolite, at least one Group VIII metal and at least one low surface area, metal oxide refractory binder, and wherein the dewaxing catalyst comprises a micropore surface area to total surface area of greater than or equal to 25%, wherein the total surface area equals the surface area of the external zeolite plus the surface area of the binder.

23. The method of claim 22 wherein the effluent from the at least one high pressure separator includes dissolved $H_2S$ and optionally organic sulfur.

24. The method of claim 23 wherein the effluent from the at least one high pressure separator is recombined with a hydrogen containing gas.

25. The method of claim 24 wherein the hydrogen containing gas includes $H_2S$.

26. The method of claim 22 wherein the hydrotreated feedstock is chosen from a hydrocracker bottoms, a raffinate, a wax and combinations thereof.

27. The method of claim 22 wherein the hydrogen gas is chosen from a hydrotreated gas effluent, a clean hydrogen gas, a recycle gas and combinations thereof.

28. The method of claim 22, wherein the hydrotreated feedstock is hydroprocessed under effective hydroprocessing conditions chosen from hydroconversion, hydrocracking, hydrotreatment, and dealkylation.

29. The method of claim 22 further comprising hydrofinishing the dewaxed lubricant basestock under effective hydrofinishing conditions.

30. The method of claim 29 further comprising fractionating the hydrofinished, dewaxed lubricant basestock under effective fractionating conditions.

31. The method of claim 22 further comprising fractionating the dewaxed lubricant basestock under effective fractionating conditions.

32. The method of claim 31 further comprising hydrofinishing the fractionated, dewaxed lubricant basestock under effective hydrofinishing conditions.

33. The method of claim 22, wherein the dewaxing catalyst comprises a molecular sieve having a $SiO_2$:$Al_2O_3$ ratio of 200:1 to 30:1 and comprises from 0.1 wt % to 2.7 wt % framework $Al_2O_3$ content.

34. The method of claim 33, wherein the molecular sieve is EU-1, ZSM-35, ZSM-11, ZSM-57, NU-87, ZSM-22, EU-2, EU-11, ZBM-30, ZSM-48, ZSM-23, or a combination thereof.

35. The method of claim 33, wherein the molecular sieve is EU-2, EU-11, ZBM-30, ZSM-48, ZSM-23, or a combination thereof.

36. The method of claim 33, wherein the molecular sieve is ZSM-48, ZSM-23, or a combination thereof.

37. The method of claim 33, wherein the molecular sieve is ZSM-48.

38. The method of claim 22, wherein the metal oxide refractory binder has a surface area of 100 $m^2/g$ or less.

39. The method of claim 22, wherein the metal oxide refractory binder has a surface area of 80 $m^2/g$ or less.

40. The method of claim 22, wherein the metal oxide refractory binder has a surface area of 70 $m^2/g$ or less.

41. The method of claim 22, wherein the metal oxide refractory binder is silica, alumina, titania, zirconia, or silica-alumina.

42. The method of claim 22, wherein the metal oxide refractory binder further comprises a second metal oxide refractory binder different from the first metal oxide refractory binder.

43. The method of claim 42, wherein the second metal oxide refractory binder is silica, alumina, titania, zirconia, or silica-alumina.

44. The method of claim 22, wherein the dewaxing catalyst includes from 0.1 to 5 wt % platinum.

* * * * *